US007696943B2

(12) United States Patent
Chiang

(10) Patent No.: US 7,696,943 B2
(45) **Date of Patent: *Apr. 13, 2010**

(54) LOW COST MULTIPLE PATTERN ANTENNA FOR USE WITH MULTIPLE RECEIVER SYSTEMS

(75) Inventor: Bing A. Chiang, Melbourne, FL (US)

(73) Assignee: IPR Licensing, Inc., Wilmington, DE (US)

( * ) Notice: Subject to any disclaimer, the term of this patent is extended or adjusted under 35 U.S.C. 154(b) by 464 days.

This patent is subject to a terminal disclaimer.

(21) Appl. No.: 11/604,013

(22) Filed: Nov. 22, 2006

(65) Prior Publication Data

US 2007/0210974 A1 Sep. 13, 2007

Related U.S. Application Data

(63) Continuation-in-part of application No. 11/101,914, filed on Apr. 8, 2005, now Pat. No. 7,253,783, which is a continuation of application No. 10/664,413, filed on Sep. 17, 2003, now Pat. No. 6,894,653.

(60) Provisional application No. 60/411,570, filed on Sep. 17, 2002.

(51) Int. Cl.
*H01Q 19/00* (2006.01)

(52) U.S. Cl. ..... 343/833; 343/757; 343/853

(58) Field of Classification Search ..... 343/757, 343/833, 834, 853
See application file for complete search history.

(56) References Cited

U.S. PATENT DOCUMENTS 4,169,266 A 9/1979 Bachvarov
5,243,358 A 9/1993 Sanford et al.
5,257,031 A 10/1993 Scarpetta et al.
5,485,167 A 1/1996 Wong et al.

(Continued)

FOREIGN PATENT DOCUMENTS

DE 27 29 395 1/1979

(Continued)

OTHER PUBLICATIONS

Lo, Y.T., & Lee, S.W., editors, *Antenna Handbook, Theory, Applications and Design*, pp. 3-21-3-43, Van Nostrand Reinhold Co., New York 1988.

*Primary Examiner*—Tan Ho
(74) *Attorney, Agent, or Firm*—Volpe and Koenig, P.C.

(57) ABSTRACT

An antenna assembly includes at least two active or main radiating omni-directional antenna elements arranged with at least one beam control or passive antenna element used as a reflector. The beam control antenna element(s) may have multiple reactance elements that can electrically terminate it to adjust the input or output beam pattern(s) produced by the combination of the active antenna elements and the beam control antenna element(s). More specifically, the beam control antenna element(s) may be coupled to different terminating reactances to change beam characteristics, such as the directivity and angular beam width. Processing may be employed to select which terminating reactance to use. Consequently, the radiator pattern of the antenna can be more easily directed towards a specific target receiver/transmitter, reduce signal-to-noise interference levels, and/or increase gain. A Multiple-Input, Multiple-Output (MIMO) processing technique may be employed to operate the antenna assembly with simultaneous beam patterns.

11 Claims, 21 Drawing Sheets

U.S. PATENT DOCUMENTS

| | | | | |
|---|---|---|---|---|
| 5,767,807 | A | 6/1998 | Pritchett | |
| 6,310,585 | B1 | 10/2001 | Marino | |
| 6,369,770 | B1 | 4/2002 | Gothard et al. | |
| 6,397,082 | B1 | 5/2002 | Searle | |
| 6,515,635 | B2 | 2/2003 | Chiang et al. | |
| 6,600,456 | B2 | 7/2003 | Gothard et al. | |
| 6,788,268 | B2 | 9/2004 | Chiang et al. | |
| 6,894,653 | B2 * | 5/2005 | Chiang et al. | 343/757 |
| 7,202,835 | B2 * | 4/2007 | Chiang et al. | 343/834 |
| 7,253,783 | B2 * | 8/2007 | Chiang et al. | 343/757 |
| 7,391,386 | B2 * | 6/2008 | Sawaya et al. | 343/833 |
| 7,463,201 | B2 * | 12/2008 | Chiang et al. | 343/702 |
| 2003/0030594 | A1 | 2/2003 | Larry | |
| 2003/0048226 | A1 | 3/2003 | Gothard et al. | |

FOREIGN PATENT DOCUMENTS

| | | |
|---|---|---|
| EP | 0 523 409 | 6/1992 |
| WO | 01/56189 | 8/2001 |

* cited by examiner 4.2753e+000

4.0633e+000

3.8470e+000

LOW COST MULTIPLE PATTERN ANTENNA FOR USE WITH MULTIPLE RECEIVER SYSTEMS

RELATED APPLICATIONS

This application is a continuation in part of U.S. application Ser. No. 11/101,914, filed Apr. 8, 2005 now U.S. Pat. No. 7,253,783, which is a continuation of U.S. application Ser. No. 10/664,413, filed Sep. 17, 2003 now U.S. Pat. No. 6,894,653, which claims the benefit of U.S. Provisional Application No. 60/411,570 filed on Sep. 17, 2002. The entire teachings of the above applications are incorporated herein by reference.

BACKGROUND OF THE INVENTION

It is becoming increasingly important to reduce the size of radio equipment to enhance its portability. For example, the smallest available cellular telephone handset today can conveniently fit into a shirt pocket or small purse. In fact, so much emphasis has been placed on obtaining small size for radio equipment that corresponding antenna gains are extremely poor. For example, antenna gains of the smallest handheld phones are only −3 dBi or even lower. Consequently, the receivers in such phones generally do not have the ability to mitigate interference or reduce fading.

Some prior art systems provide multiple element beam formers for these purposes. These antenna systems are characterized by having at least two radiating elements and at least two receivers that use complex magnitude and phase weighting filters. These functions can be implemented either by discrete analog components or by digital signal processors. The problem with this type of antenna system is that performance is heavily influenced by the spatial separation between the antenna elements. If the antennas are too close together or if they are arranged in a sub-optimum geometry with respect to one another, then the performance of the beam forming operation is severely limited. This is indeed the case in many compact wireless electronic devices, such as cellular handsets, wireless access points, and the like, where it is very difficult to obtain sufficient spacing or proper geometry between antenna elements to achieve improvement.

Indoor multipaths, mostly outside the main beam, interfere with the main beam signal and create fading. The indoor multi paths also create standing wave nulls that prevent reception if the directive antenna is situated at these nulls. For a traditional array, if one element of the array is at the null, the received signal is still significantly reduced. Reciprocity makes this effect hold true for the transmit direction, too.

SUMMARY OF THE INVENTION

This invention relates to an adaptive antenna array for a wireless communications application that optionally uses multiple receivers. The invention provides a low cost, compact antenna system that offers high performance with the added advantage of providing multiple isolated spatial antenna beams or effecting an aggregate antenna beam. It can be used for multiple simultaneous receive and transmit functions, suitable for Multiple-Input, Multiple Output (MIMO) applications.

Devices that can benefit from the technology underlying the invention include, but are not limited to, cellular telephone handsets such as those used in Code Division Multiple Access (CDMA) systems such as IS-95, IS-2000, CDMA 2000 and the like, Time Division Multiple Access (TDMA) systems, Frequency Division Multiple Access (FDMA) systems, wireless local area networking equipment such as IEEE 802.11 or WiFi access equipment, and/or military communications equipment such as ManPacks, and the like.

In one embodiment, an antenna assembly includes at least two active or main radiating antenna elements arranged with at least one beam control or passive antenna element electromagnetically disposed between them. The beam control antenna element(s), referred to herein as beam control or passive antenna element(s), is/are not used as active antenna element(s). Rather, the beam control antenna element(s) is/are used as a reflector by terminating its/their signal terminal(s) into fixed or variable reactance(s). As a result, a system using the antenna assembly can adjust the input or output beam pattern produced by the combination of at least one main radiating antenna elements and the beam control antenna element(s). More specifically, the beam control antenna element(s) may be connected to different terminating reactances, optionally through a switch, to change beam characteristics, such as the directivity and angular beam width, or the beam control antenna element(s) may be directly attached to ground. Processing may be employed to select which terminating reactance to use.

Consequently, the radiation pattern of the antenna can be more easily directed towards a specific target receiver/transmitter, reduce signal-to-noise interference levels, and/or increase gain. The radiation pattern may also be used to reduce multipath effects, including indoor multipath effects. One result is that cellular fading can be minimized.

In one embodiment, at least one beam control antenna element is positioned to lie along a common line with the two active antenna elements, referred to as a one-dimensional array or curvi-linear array. However, the degree to which the active and beam control antenna elements lie along the same line can vary, depending upon the specific needs of the application. In another embodiment, more than two active antenna elements are arranged in a predetermined shape, such as a circle, with at least one beam control antenna element electromagnetically coupled to the active antenna elements. Shapes beyond the one-dimensional array or curvi-linear array are generally referred to as a two-dimensional array.

The spacing of the active antenna elements with respect to the beam control antenna elements can also vary upon the application. For example, the beam control antenna element can be positioned about one-quarter wavelength from each of the two active antenna elements to enhance beam steering capabilities. This may translate to a spacing to between approximately 0.5 and 1.5 inches for use in certain compact portable devices, such as cellular telephone handsets. Such an antenna system will work as expected, even though such a spacing might be smaller than one-quarter of a corresponding radio wavelength at which the antennas are expected to operate.

The invention has many advantages over the prior art. For example, the combination of active antenna elements with the beam control antenna element(s) can be employed to adjust the beam width of an input/output beam pattern. Using few components, an antenna system using the principles of the present invention can be easily assembled into a compact device, such as in a portable cellular telephone or Personal Digital Assistant (PDA). Consequently, this steerable antenna system can be inexpensive to manufacture.

According to another aspect of the present disclosure, the apparatus includes multiple active antenna elements and multiple beam control antenna elements electromagnetically coupled to the active antenna elements and electromagnetically disposed between the active antenna elements. The multiple beam control antenna elements are offset from an axis defined by at least two active antenna elements.

According to a further embodiment, the apparatus includes multiple active antenna elements arranged in a linear configuration and multiple beam control antenna elements electromagnetically coupled to the multiple active antenna elements and electromagnetically disposed between at least two of the active antenna elements. The multiple beam control antenna elements interspersed among the multiple active antenna elements in a configuration approximating at least a portion of a trigonometric function. In another embodiment, at least some of the multiple active antenna elements and some of the multiple beam control antenna element are disposed in a plurality of rows. The beam control antenna element of a first row is offset relative to the beam control antenna element of an adjacent second row. The beam control antenna element of the second row is offset relative to the beam control antenna element of a third row and is substantially aligned with the beam control antenna element of the first row. The beam control antenna elements for each of the first, second, and third rows approximate a portion of a sine wave.

According to a further embodiment, the apparatus includes multiple active antenna elements and multiple beam control antenna elements electromagnetically coupled to the multiple active antenna elements and electromagnetically disposed between at least two of the active antenna elements. At least a subset of the multiple active antenna elements and a subset of the multiple beam control antenna element are disposed in a plurality of rows for a predetermined array. The apparatus also includes a plurality of beam control antenna elements positioned outside of the array and configured to provide for an active antenna gain of the array.

According to a further embodiment, the apparatus includes a number of active antenna elements and a beam control antenna element electromagnetically coupled to the active antenna elements and electromagnetically disposed between the active antenna elements. The active antenna elements are configured to operate in different frequency ranges.

According to a further embodiment, the apparatus includes a plurality of dual band active antenna elements and a plurality of beam control antenna elements electromagnetically coupled to the plurality of dual band active antenna elements and electromagnetically disposed in a first position. The dual band active antenna elements surround the first position. The dual band active antenna elements are configured to operate in different frequency ranges with at least one dual band active antenna element operating in a first frequency range and another operating in another second frequency range.

According to a further embodiment, the apparatus includes at least two active antenna elements with each coupled to a respective receiver and a transmitter and configured to form multiple simultaneous beams. The apparatus also has a beam control antenna element that is coupled to a switch with the switch operatively coupling the beam control antenna elements a device to effect at least one antenna beam pattern formed by the at least two active antenna elements. The apparatus also has a controller. The controller is coupled to the beam control antenna element and is coupled to the respective receiver and transmitter. The controller is configured to switch between transmitting and receiving in a directional mode or transmitting and receiving in an omni-directional mode.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
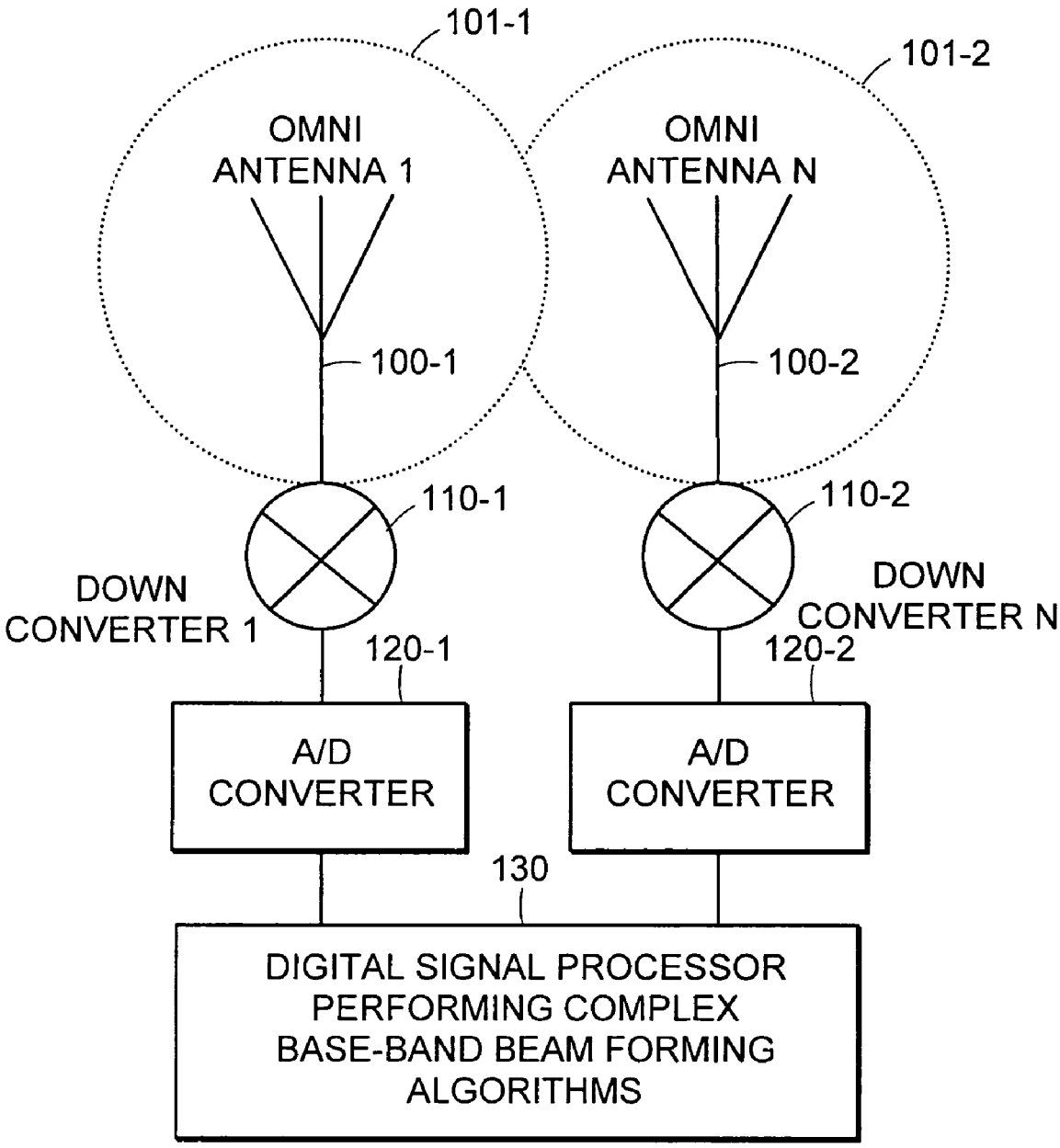
PRIOR ART FIG. 1
FIG. 1 is a schematic diagram of a prior art beam former antenna system with two active antenna elements.

FIG. 1 illustrates prior art multiple element beam former. Such systems are characterized by having at least two active or radiating antenna elements 100-1, 100-2 that have associated omni-directional radiating patterns 101-1, 101-2, respectively. The antenna elements 100 are each connected to a corresponding radio receiver, such as down-converters 110-1 and 110-2, which provide baseband signals to a respective pair of Analog-to-Digital (A/D) converters 120-1, 120-2. The digital received signals are fed to a digital signal processor 130. The digital signal processor 130 then performs baseband beam forming algorithms, such as combining the signals received from the antenna elements 100 with complex magnitude and phase weighting functions.

One difficulty with this type of system is that performance is heavily influenced by the spatial separation and geometry of the antenna elements 100. For example, if the antenna elements 100 are spaced too close together, then performance of the beam forming operation is reduced. Furthermore, the antenna elements 100 themselves must typically have a geometry that is of an appropriate type to provide not only the desired omni-directional pattern but also operate within the geometry for the desired wavelengths. Thus, this architecture is generally not of desirable use in compact, hand held wireless electronic devices, such as cellular telephones and/or low cost wireless access points or stations (sometimes referred to as a client device or station device), where it is difficult to obtain sufficient spacing between the elements 100 or to manufacture antenna geometries at low cost.

In contrast to this, one aspect of the present invention is to form directional multiple fixed antenna beams, such as a semi-omni or so called "peanut" pattern in a very small space. Specifically, referring to FIG. 2, there is the same pair of active antenna elements 100-1, 100-2 as in the prior art of FIG. 1; however, according to the principles of the present invention, a passive or beam control antenna element 115 is inserted between the active antenna elements 100. In a receive mode, received signals are fed to the corresponding pair of down converters 110-1, 110-2, A/D converters 120-1, 120-2, and Digital Signal Processor (DSP) 130, as in the prior art.

With this arrangement, two beams 180-1, 180-2 may be formed simultaneously in opposite directions when the beam control antenna element 115 is switched or fed to a first terminating reactance 150-1. The first terminating reactance 150-1 is specifically selected to cause the beam control antenna element 115 to act as a reflector in this mode. Since these two patterns 180-1, 180-2 cover approximately one-half of a hemisphere, they are likely to provide sufficient directivity performance for a useable antenna system.

In an optional configuration, if different antenna patterns are required, such as a "peanut" pattern 190 illustrated by the dashed line, then a multiple element switch 170 can be utilized to electrically connect a second terminating reactance 150-2 with the beam control antenna element 115. The multiple element switch 170 may be used to select among multiple reactances 150 to achieve a combination of the different patterns, resulting in one or more "peanut" patterns 190.

Thus, it is seen how the center beam control antenna element 115 can be connected either to a fixed reactance or switched into different reactances to generate different antenna patterns 180, 190 at minimal cost. In the preferred embodiment, at least three antenna elements, including the two active antenna elements 100 and single passive element 115, are disposed in a line such that they remain aligned in parallel. However, it should be understood that in certain embodiments they may be arranged at various angles with respect to one another.

Various other numbers and configurations of the antenna elements 100, switch 170, and passive beam control antenna element(s) 115 are possible. For example, multiple active antenna elements 100 (e.g., sixteen) may be used with four passive beam control antenna elements 115 interspersed among the active antenna elements 100, where each passive beam control antenna element 115 is electromagnetically coupled to a subset of the active antenna elements 100, where a subset may be as few as two or as many as sixteen, in the example embodiment.

Figure 3:
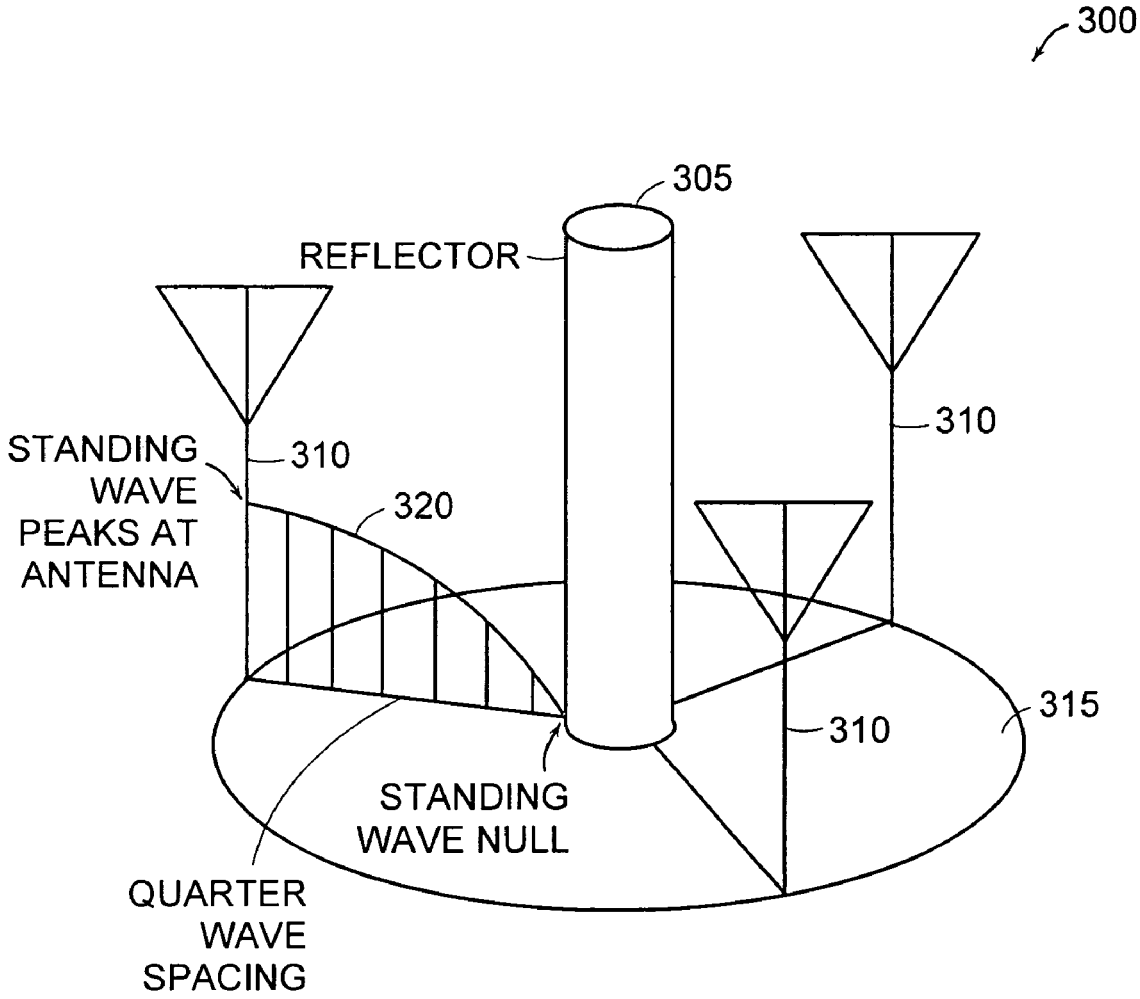
FIG. 3 is a diagram of another embodiment of the antenna assembly of FIG. 2.

Another embodiment of an antenna assembly according to the principles of the present invention is now discussed in reference to an antenna assembly 300 depicted in FIG. 3. The antenna assembly 300 uses a reflector or beam control antenna element 305, or multiple reflector antenna elements (not shown), and a phased array of active antenna elements 310. The antenna elements 305, 310 are, in this embodiment, mechanically disposed on a ground plane 315. The reflector antenna element 305 is used to create its own multi-path.

This multi-path is simple and is inside the active antenna elements 310. Because of the close proximity of the reflector antenna element 305 to the active antenna elements 310, its presence overrides other multi-paths and remove the nulls created by them. The new multi-path has a predictable property and is thus controllable. The phased array can be used to focus its beam on a signal, and the combination of reflector antenna element 305 and active antenna elements 310 removes fading and signal path misalignment, which creates "ghosts" often seen in TV receptions.

Figure 4A:
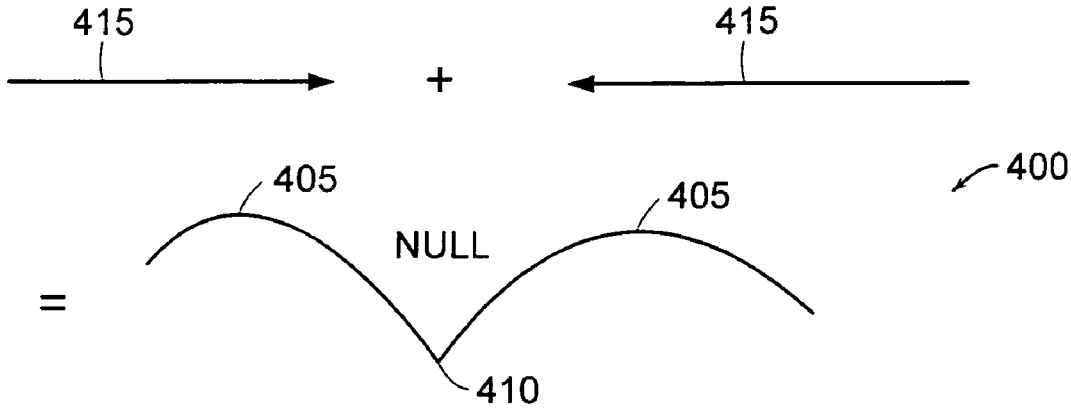
FIG. 4A is a generalized wave diagram related to the antenna assembly of FIG. 1.

In this embodiment, the reflector 305 is cylindrical and is situated in the center of the circular array 300 of active antenna elements 310. This distance between the active antenna elements 310 and the conducting surface of the reflector antenna elements 305 may be kept at a quarter wave length or less. The presence of the cylindrical reflector antenna element 305 prevents any wave from propagating through the array 300 of active antenna elements 310. It thus prevents the formation of standing waves created by the interfering effect of oppositely traveling waves 405, as indicated by the arrows 415 in FIG. 4A. The result is that the indoor nulls 410 are removed from the vicinity of the array elements 310. However, the beam control antenna element 305 creates its own standing waves, as depicted in FIG. 4B.

Figure 4B:
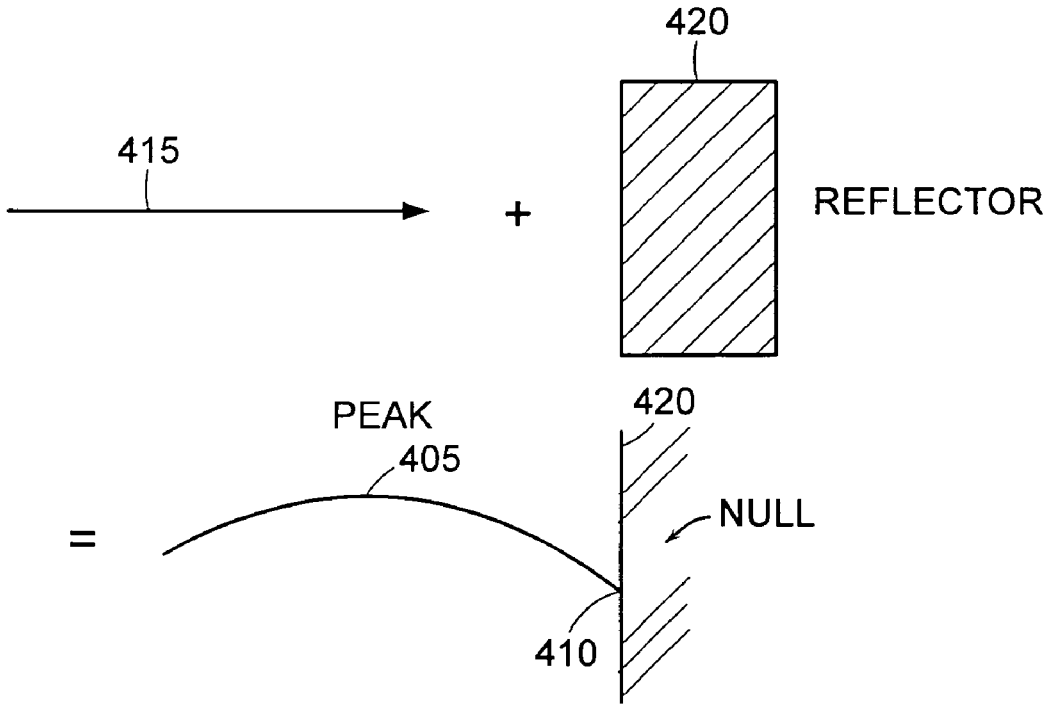
FIG. 4B is a wave diagram related to the antenna assemblies of FIGS. 2 and 3.

Referring now to FIG. 4B, the traveling wave 405 travels toward (i.e., arrow 415) a reflector 420. The reflector 420 forms a node 410 at the reflector 420 and standing wave 405 having a peak at the antenna elements 310 surrounding the reflector antenna element 305 as a result of the quarter wave spacing. So, with this arrangement, the nulls from the environment are removed, and, at the same time, this arrangement confines the signal peaks to the active antenna elements 310, which are ready to be phased into a beam that points to the strongest signal path, as determined by a processor (e.g., FIG. 2, DSP 130) coupled to the antenna array 300.

Figure 2:
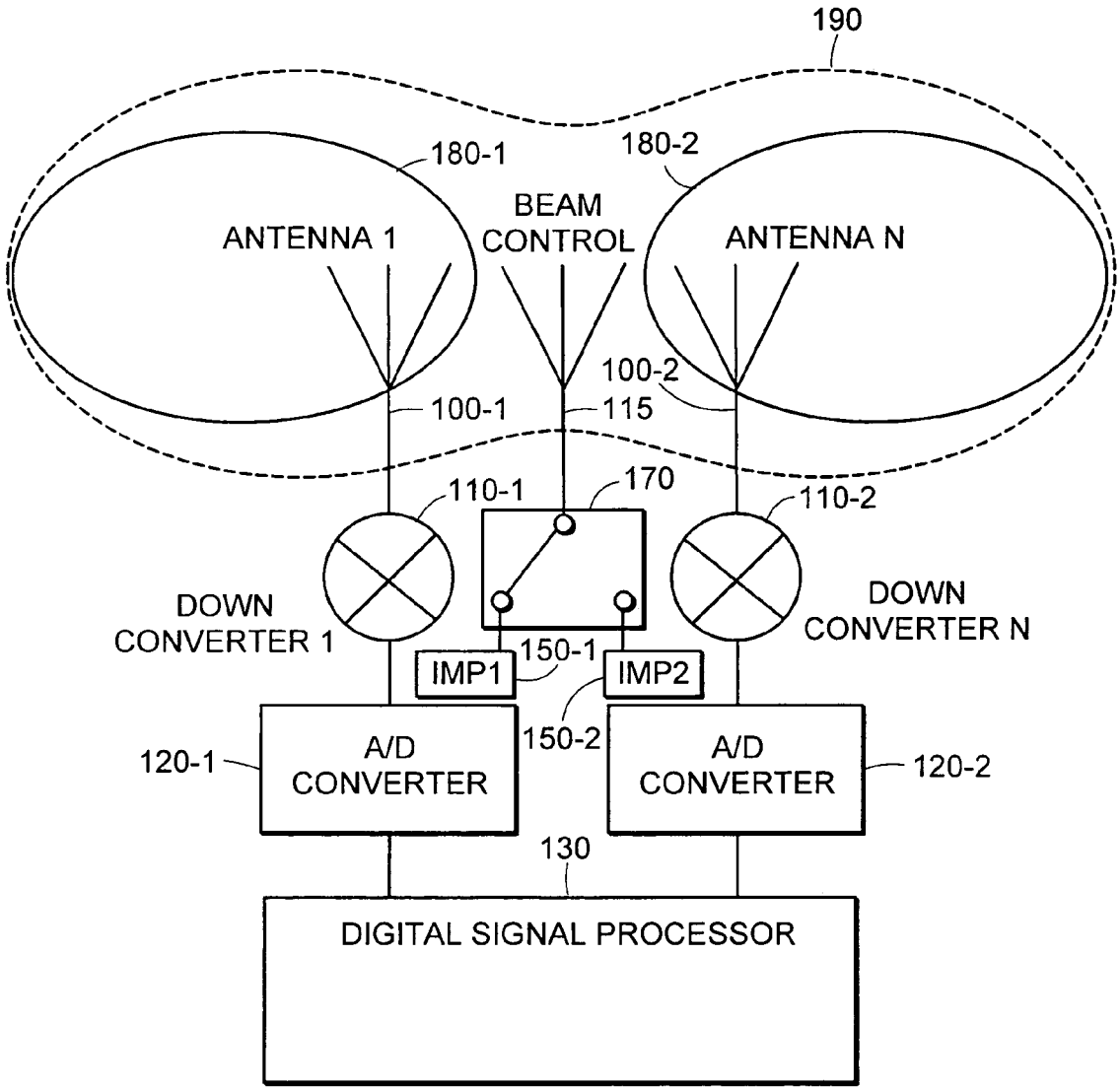
FIG. 2 is a schematic diagram of a beam former antenna system with an antenna assembly including two active antenna elements and one beam control antenna element according to the principles of the present invention.
Figure 5:
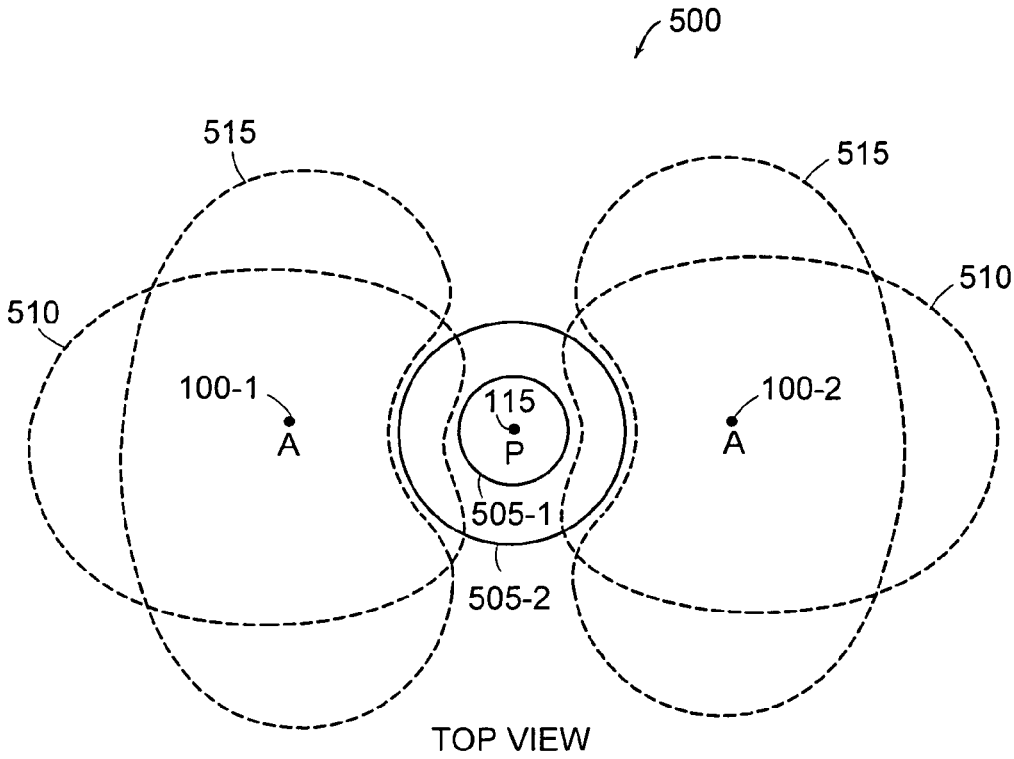
FIG. 5 is a top view of a beam pattern formed by another embodiment of the beam former system of FIG. 2.

FIG. 5 is a top view of example antenna beam patterns 500 formed by the linear antenna assembly of FIG. 2. In this embodiment, the beam control antenna element 115 is electrically connected to reactance components (e.g., FIG. 2, reactance components 150-1, 150-2) that creates respective effective reflective rings 505-1, 505-2. For example, the more inductance, the smaller the effective diameter of the ring 505 about the beam control antenna element 115.

Responsively, the antenna beam patterns 510, 515 produced by the antenna assembly 500, arranged in a linear array, are kidney shaped, as depicted by dash lines. As should be understood, the smaller the diameter of the reflection rings 505, the narrower the beam and, consequently, more gain, that is provided to the active antenna elements 100 in a perpendicular direction to the axis of the linear array. Note that the uncoupled antenna beam patterns 510, 515 do not form a "peanut" pattern as in FIG. 2, which is caused in part by the selection of the reactance components 150.

A secondary advantage of having this active/beam control/active antenna element arrangement is that the beam control antenna element 115 tends to isolate the two active antenna elements 100, so there is a potential to reduce the size of the array. It should be understood that the active antenna elements 100 may be spaced closer to one another or farther apart from one another, depending on the application. Further, the reflective antenna element 115 electromagnetically disposed between the active antenna elements 100 reduces losses due to mutual coupling. However, loading on the beam control antenna element 115 may make it directive instead of reflective, which increases coupling between the active antenna elements 100 and coupling losses due to same. So, there is a range of reactances that can be applied to the beam control antenna element 115 that is appropriate for certain applications.

Continuing to refer to FIG. 5, there are two basic modes of operation of the antenna array: (1) dual beam high gain (i.e., non-omnidirectional) mode, where the beam control antenna element 115 is reflective and (2) dual near-omni mode with low mutual coupling, where the center antenna element 115 is short enough but not too short so each active antenna element 100 sees the kidney-shaped beam 510, 515, as shown. The reason this is near-omni is because the antenna array is not circular, so it is not a true omni-directional mode. As discussed above, changing the reactance electrically connected to the beam control antenna element 115 changes the mode of operation of the antenna array 500.

Examples of the reactances that may be applied to this center passive antenna element 115 are between about −500 ohms and 500 ohms. Also the height of the active antenna elements 100 may be about 1.2 inches, and the height of the passive antenna element 115 may be about 1.45 inches at an operating frequency of 2.4 GHz. It should be understood that these reactances and dimensions are merely exemplary and can be changed by proportionate or disproportionate scale factors.

Figure 6:
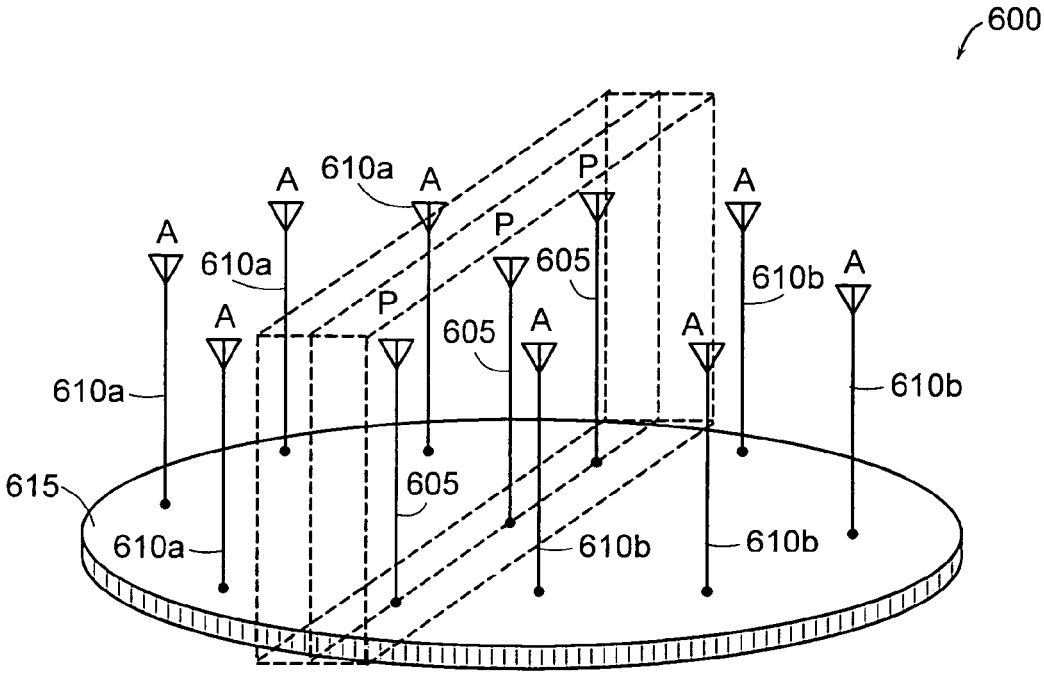
FIG. 6 is a diagram of another embodiment of the antenna assembly of FIG. 2.

FIG. 6 is a mechanical diagram of a circular antenna assembly 600. The circular antenna assembly 600 includes a subset of active antenna elements 610*a* separated by multiple beam control antenna elements 605 from another subset of active antenna elements 610*b*. The active antenna elements 610*a*, 610*b*, form a circular array. The beam control antenna elements 605 form a linear array.

The beam control antenna elements 605 are electrically connected to reactance elements (not shown). Each of the beam control antenna elements 605 may be selectably connected to respective reactance elements through switches, where the respective reactance elements may include sets of the same range of reactance or reactance values so as to increase the dimensions of a rectangular-shaped reflector 620, which surrounds the beam control antenna elements 605, by the same amount along the length of the beam control antenna elements 605. By changing the dimensions of the rectangular reflector 620, the shape of the beams produced by the active antenna elements 610*a*, 610*b* can be altered, and secondarily, the mutual coupling between the active antenna element 610*a*, 610*b* can be increased or decreased for a given application. It should be understood that more or fewer beam control antenna elements 605 can be employed for use in different applications depending on shapes of beam patterns or mutual coupling between active antenna element 610*a*, 610*b* desired. For example, instead of a linear array of beam control antenna elements 605, the array may be circular or rectangular in shape.

Figure 7:
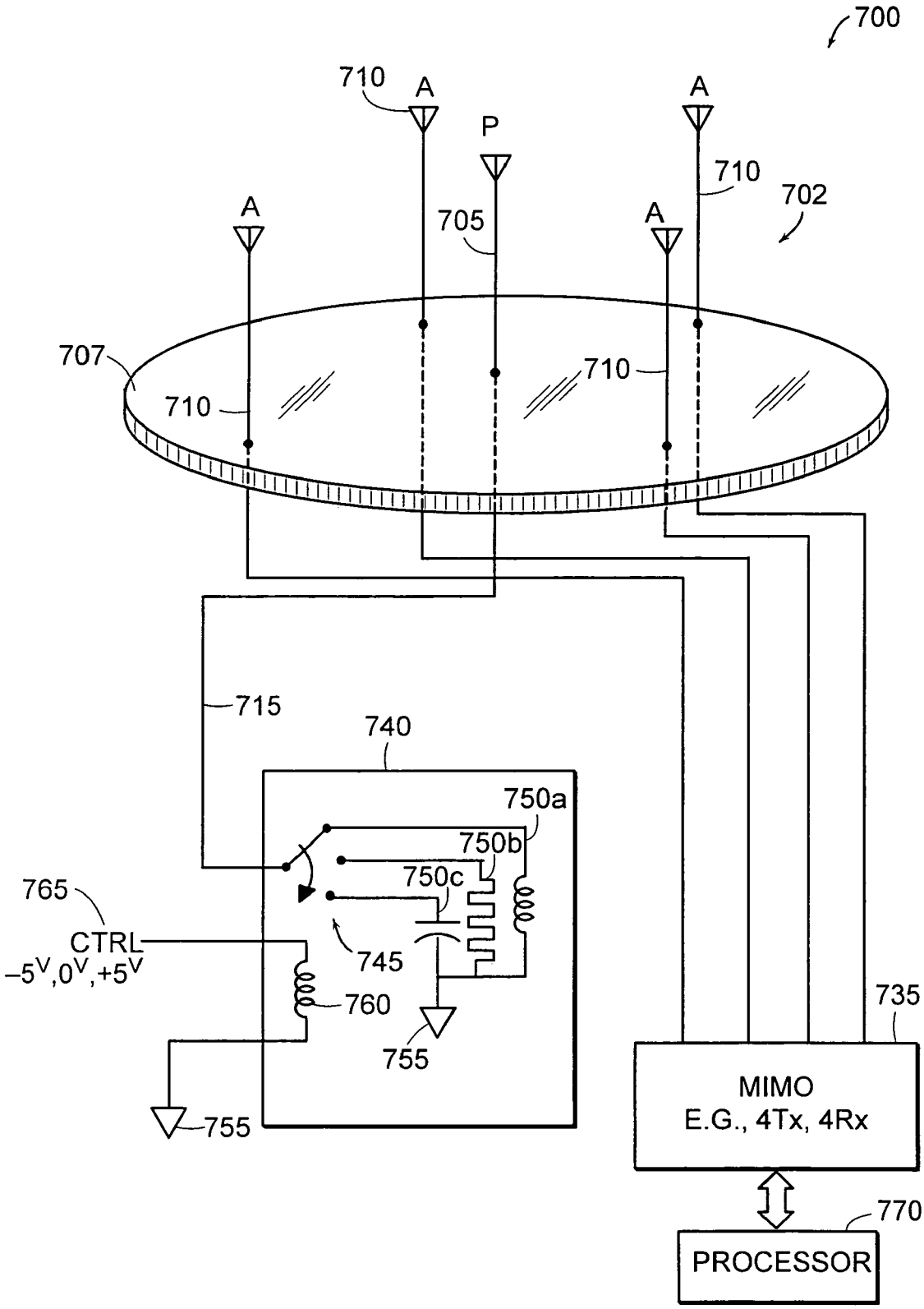
FIG. 7 is a schematic diagram of another embodiment of the beam former system of FIG. 2.

FIG. 7 is another embodiment of an antenna system 700 that includes an antenna assembly 702 with a beam control antenna element 705 and multiple active antenna elements 710 disposed on a reflective surface 707 in a circular arrangement and electromagnetically coupled to at least one beam control antenna element 705. As discussed above, the beam control antenna element 705 is electrically connected to an inductance or reactance, such as an inductor 750*a*, delay line 750*b*, or capacitor 750*c*, which are electrically connected to a ground. Other embodiments may include a lumped reactance, such as a (i) capacitor and inductor or (ii) variable reactance element that is set through the use of digital control lines. The reactive elements 750, in this embodiment, are connected to feed line 715 via a single-pole, multiple-throw switch 745. The feed line 715 connects the beam control antenna element 705 to the switch 745.

A control line 765 is connected to the ground 755 or a separate signal return through a coil 760 that is magnetically connected to the switch 745. Activation of the coil 760 causes the switch to connect the beam control antenna element 705 to ground 755 through a selected reactance element 750. In this embodiment, the switch 745 is shown as a mechanical switch. In other embodiments, the switch 745 may be a solid state switch or other type of switch with a different form of control input, such as optical control. The switch 745 and reactance elements 750 may be provided in various forms, such as hybrid circuit 740, Application Specific Integrated Circuit (ASIC) 740, or discrete elements on a circuit board.

A processor 770 may sequence outputs from the antenna array 702 to determine a direction that maximizes a signal-to-noise ratio (SNR), for example, or maximizes another beam direction related metric. In this way, the antenna assembly 702 may provide more signal capacity than without the processor 770. With the MIMO 735, the antenna system 700 can look at all sectors at all times and add up the result, which is a form of a diversity antenna with more than two antenna elements. The use of the MIMO 735, therefore, provides much increase in information throughput. For example, instead of only receiving a signal through the antenna beam in a primary direction, the MIMO 735 can simultaneously transmit or receive a primary signal and multi-path signal. Without being able to look at all sectors at all times, the added signal strength from the multi-path direction is lost.

Figure 8A:
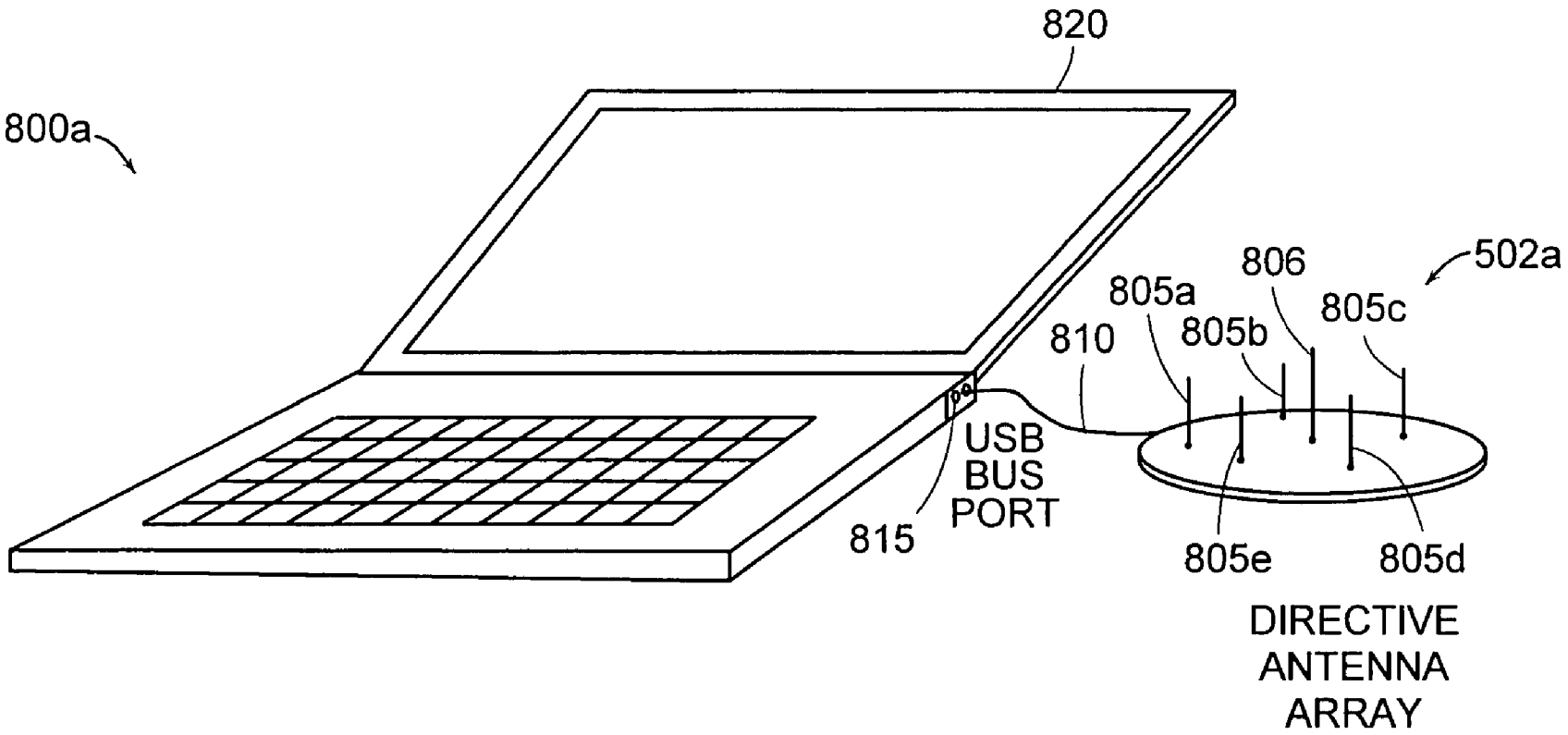
FIG. 8A is a diagram of a user station in an 802.11 network using the beam former system of FIG. 7 with external antenna assembly.

FIG. 8A is a diagram of an example use in which the directive antenna array 502*a* may be employed. In this example, a station 800*a* in an 802.11 network, for example, or a subscriber unit in a CDMA network, for example, may include a portable digital system 820 such as a personal computer, personal digital assist (PDA), or cellular telephone that uses a directive antenna assembly 502. The directive antenna assembly 502 may include multiple active antenna elements 805 and a beam control antenna element 806 electromagnetically coupled to the active antenna elements 805. The directive antenna assembly 502*a* may be connected to the portable digital system 820 via a Universal System Bus (USB) port 815.

Figure 8B:
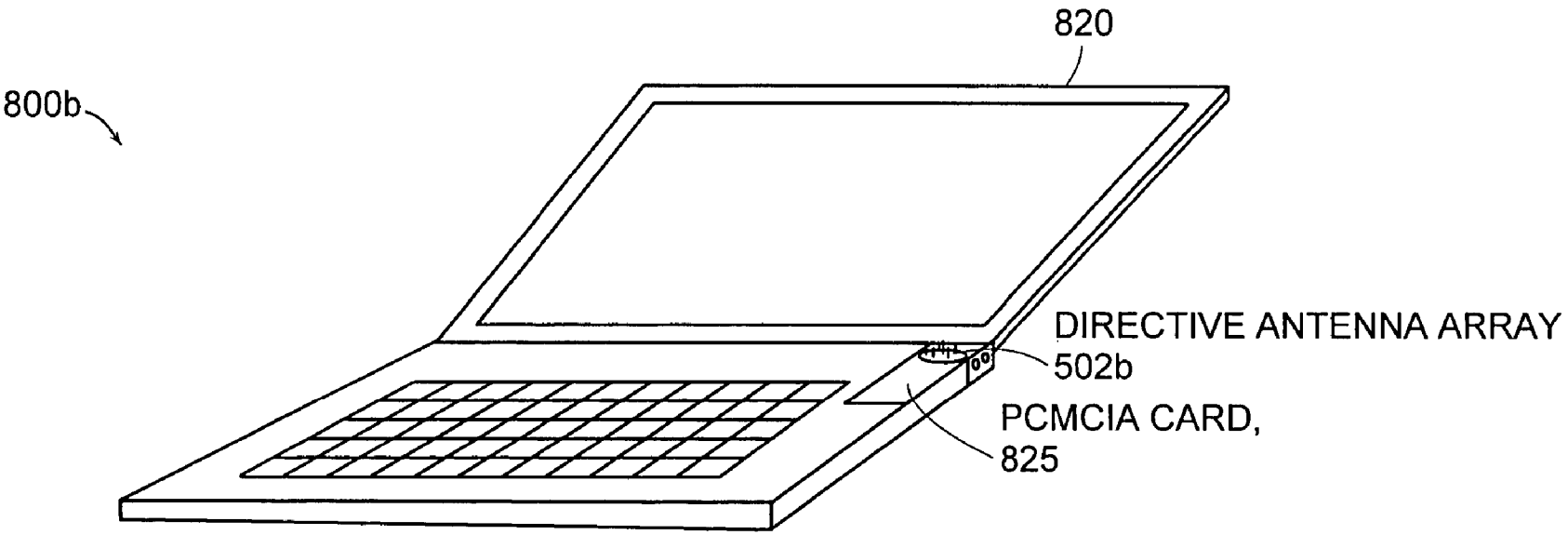
FIG. 8B is a diagram of the user station of FIG. 8A using an internal antenna assembly.

In another embodiment, a station 800*b* of FIG. 8B includes a PCMCIA card 825 that includes a directive antenna assembly 502*b* on the card 825. The PCMCIA card 825 is installed in the portable digital device 820.

It should be understood that the antenna assembly 502 in either implementation of FIG. 8A or 8B may be deployed in an Access Point (AP) in an 802.11 network or base station in a wireless cellular network. Further, the principles of the present invention may also be employed for use in other types of networks, such as a Bluetooth network and the like.

Figure 9:
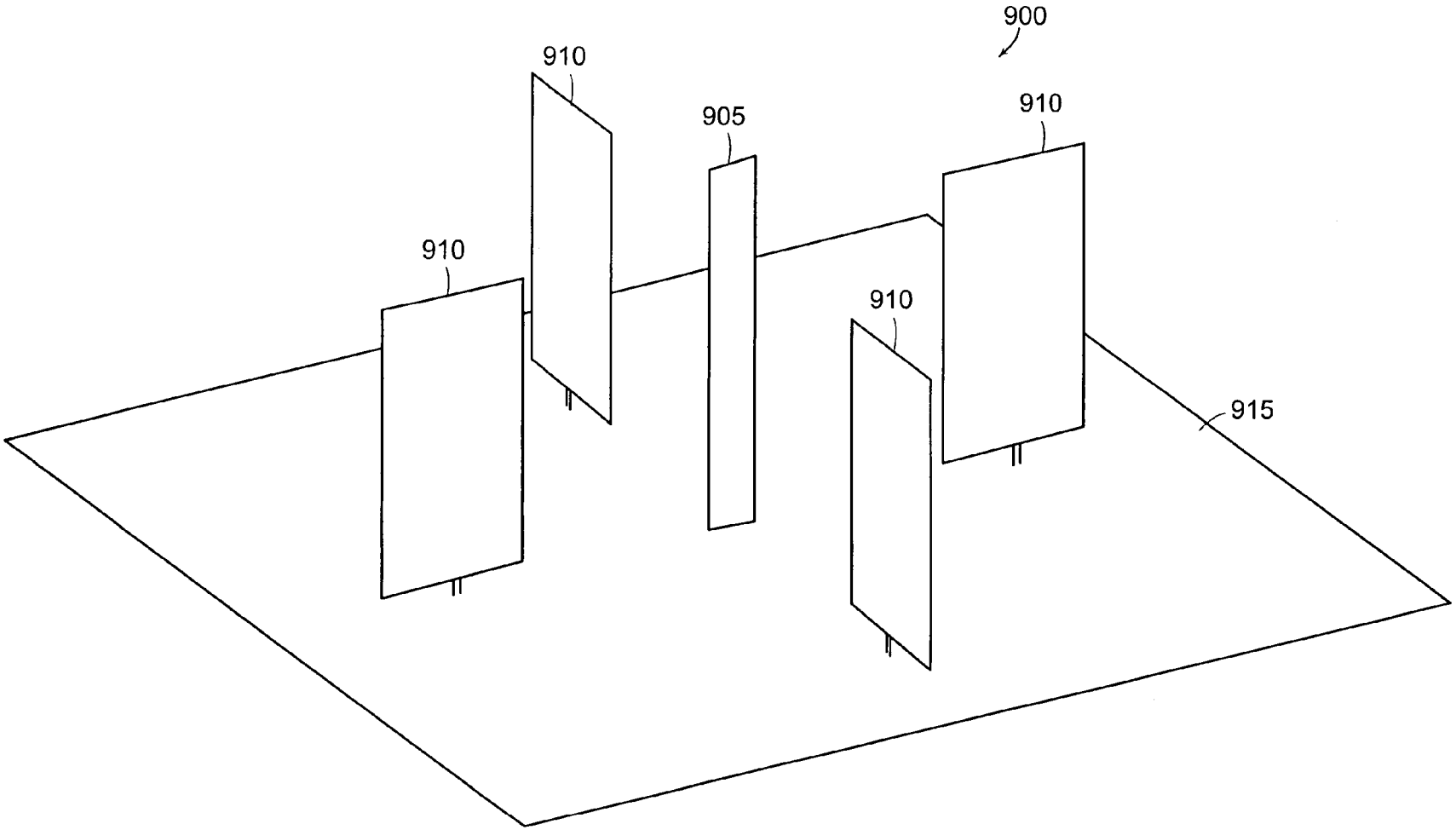
FIG. 9 is a diagram of another embodiment of the antenna assembly of FIG. 2.

FIGS. 9-11 represent an antenna assembly 900 and associated simulated antenna beam patterns produced thereby.

Referring first to FIG. 9, the antenna assembly 900 includes four active antenna elements 910 deployed along a perimeter of a circle and a central beam control antenna element 905. The antenna elements 905, 910 are mechanically connected to a ground plane 915.

In this embodiment, the active antenna elements 910 have dimensions 0.25" to 3.0" W×0.5" to 3.0" H, which are optimized for the 2.4 GHz ISM band (802.11b). The beam control antenna element 905 has dimensions 0.2"W×1.45"H. The height of the beam control antenna element 905 is longer in this embodiment to provide more reflectance and is not as wide to reduce directional characteristics.

Figure 10A:
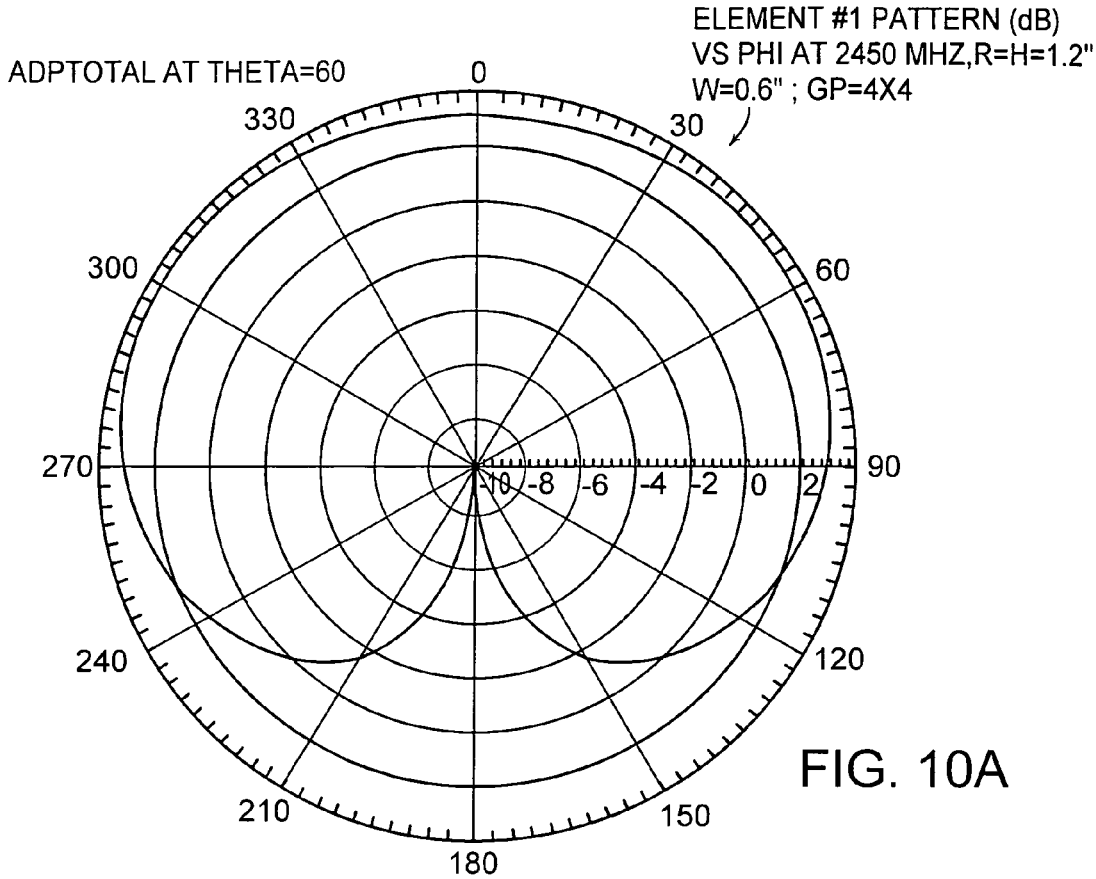
FIGS. 10A-10D are antenna directivity patterns for the antenna assembly of FIG. 9.
Figure 10B:
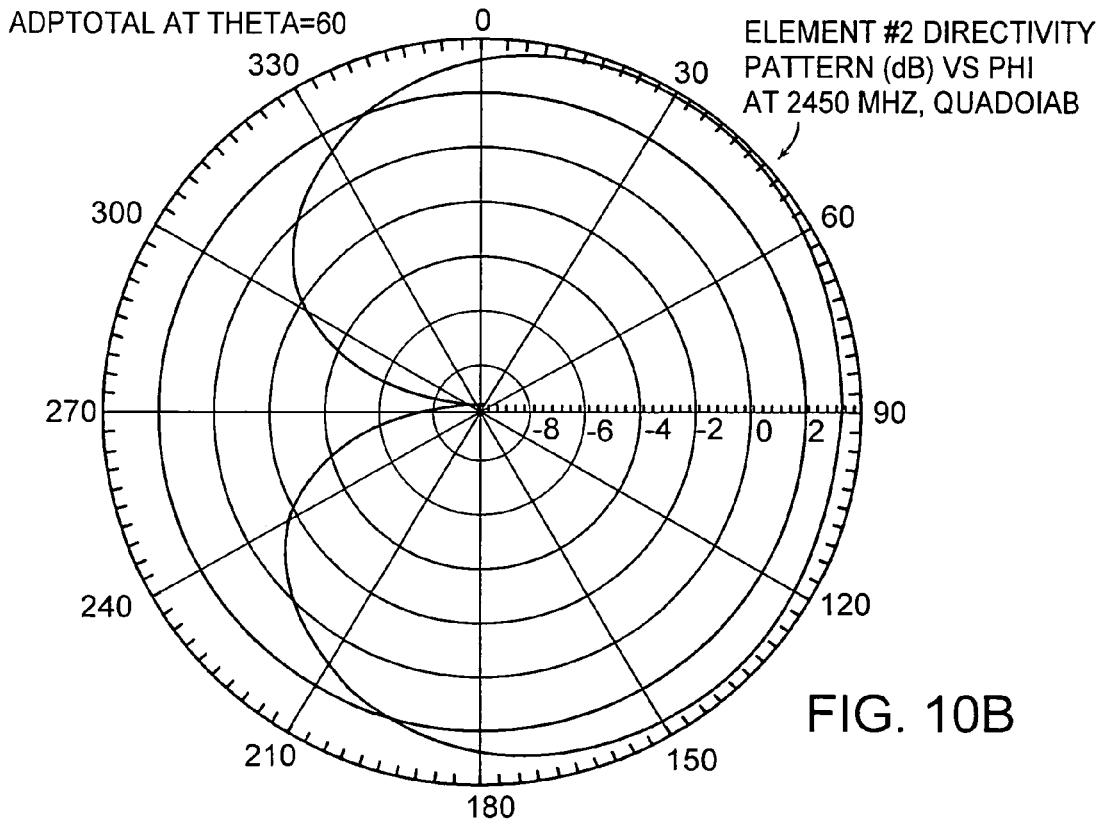
Figure 10C:
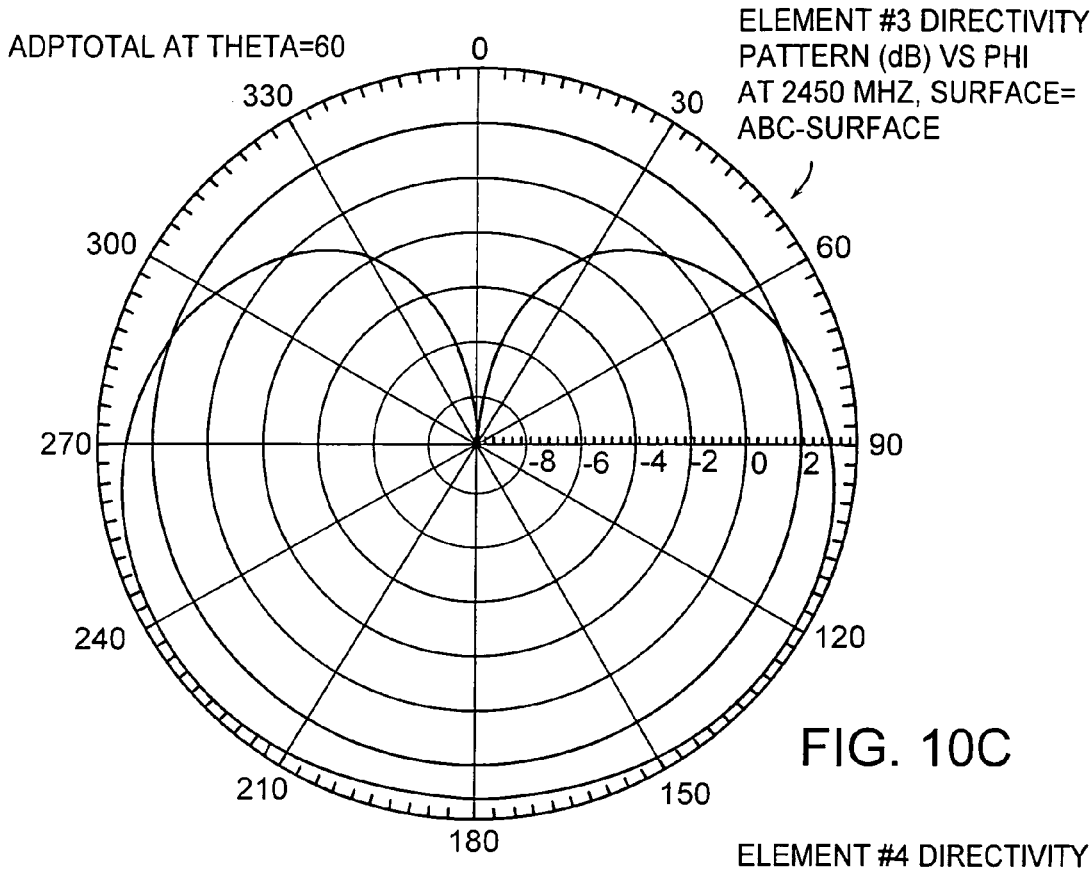
Figure 10D:
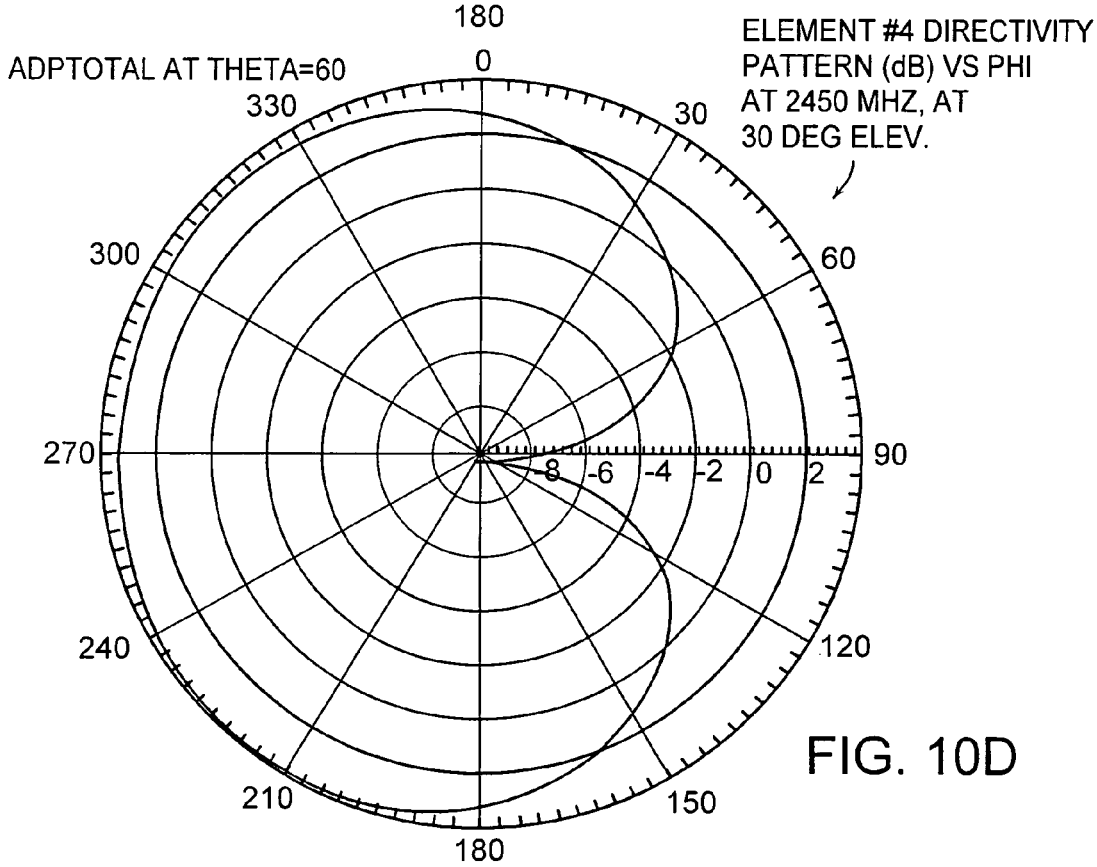
Figure 10E:
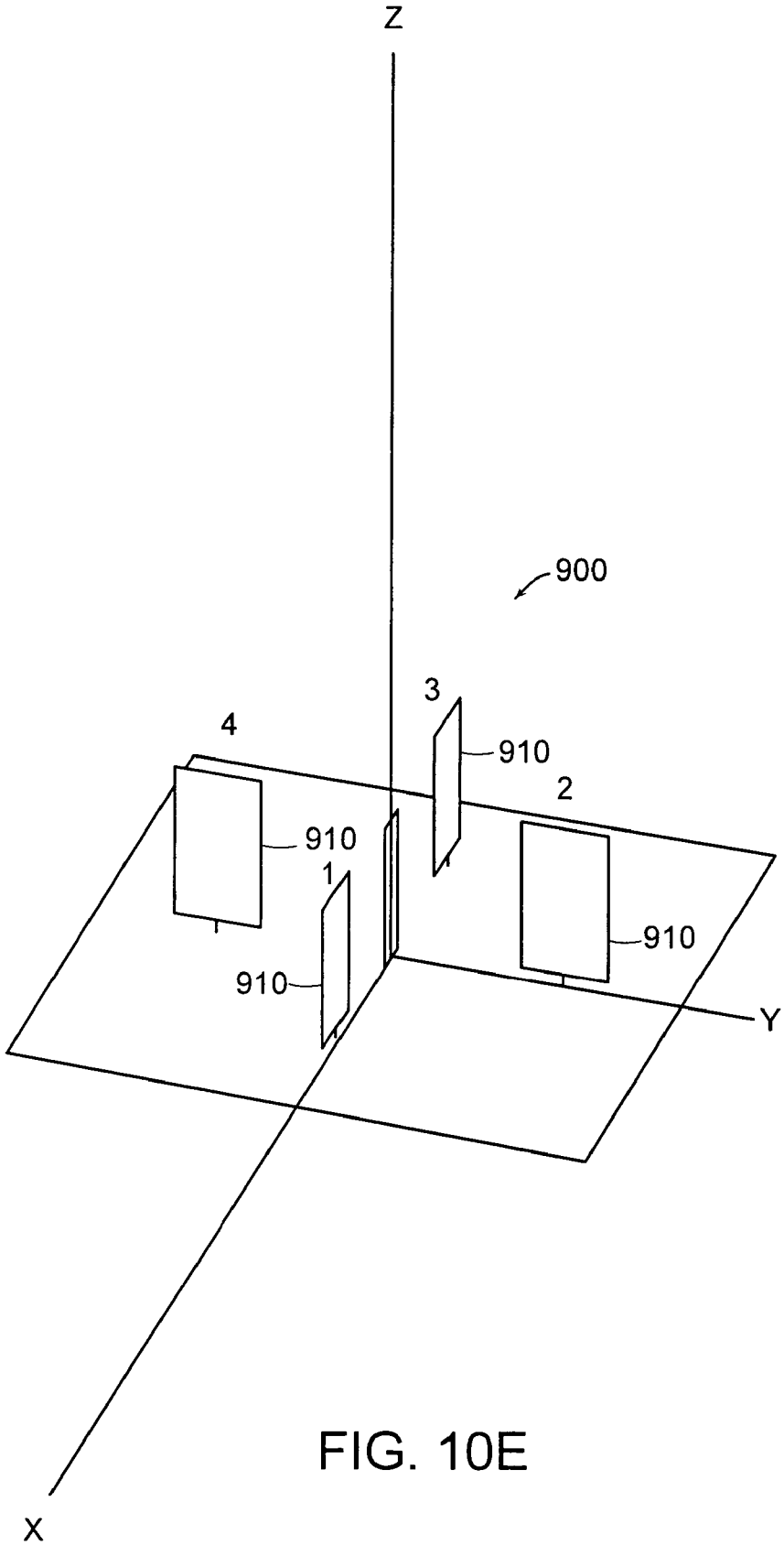
FIG. 10E is a diagram of the antenna assembly of FIG. 9 represented on x, y, and z coordinate axes.

FIGS. 10A-10D are simulated beam patterns for the antenna assembly 900 of FIG. 9. The antenna assembly 900 has been redrawn with x, y, and z axes as shown in FIG. 10E. The simulated beam patterns of FIGS. 10A-10D are for individual active antenna elements 910. The simulation is for 802.11b with a carrier frequency of 2.45 GHz. The beam patterns are shown for azimuth (x−y plane) at Phi=0 degs to 360 degs and elevation=30 degrees, or theta=60 degrees. The simulated beam pattern of FIG. 10A corresponds to the active antenna element 910 that lies along the +x axis. The null in the 180 degree direction represents the interaction between the active antenna element 910 and the beam control antenna element 905. Similarly, the simulated beam pattern of FIG. 10B corresponds to the active antenna element that lies along the +y axis; the simulated beam pattern of FIG. 10C corresponds to the active antenna element 910 that lies along the −x axis; and the simulated beam pattern of FIG. 10D corresponds to the active antenna element 910 that lies along the −y axis. The nulls in simulated beam patterns of FIGS. 10B-10D correspond to the respective active antenna elements 910 and beam control antenna element 905 interactions.

Figure 11A:
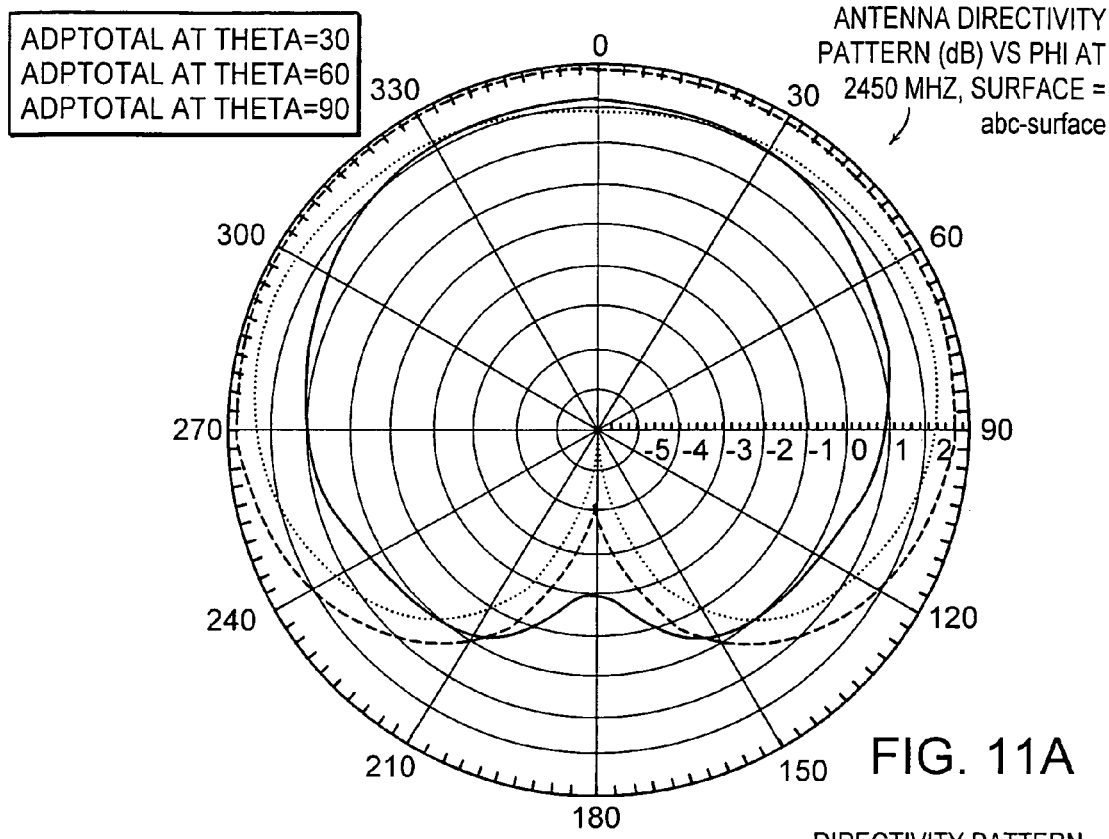
FIGS. 11A-11C are antenna directivity patterns for the antenna assembly of FIG. 9.
Figure 11B:
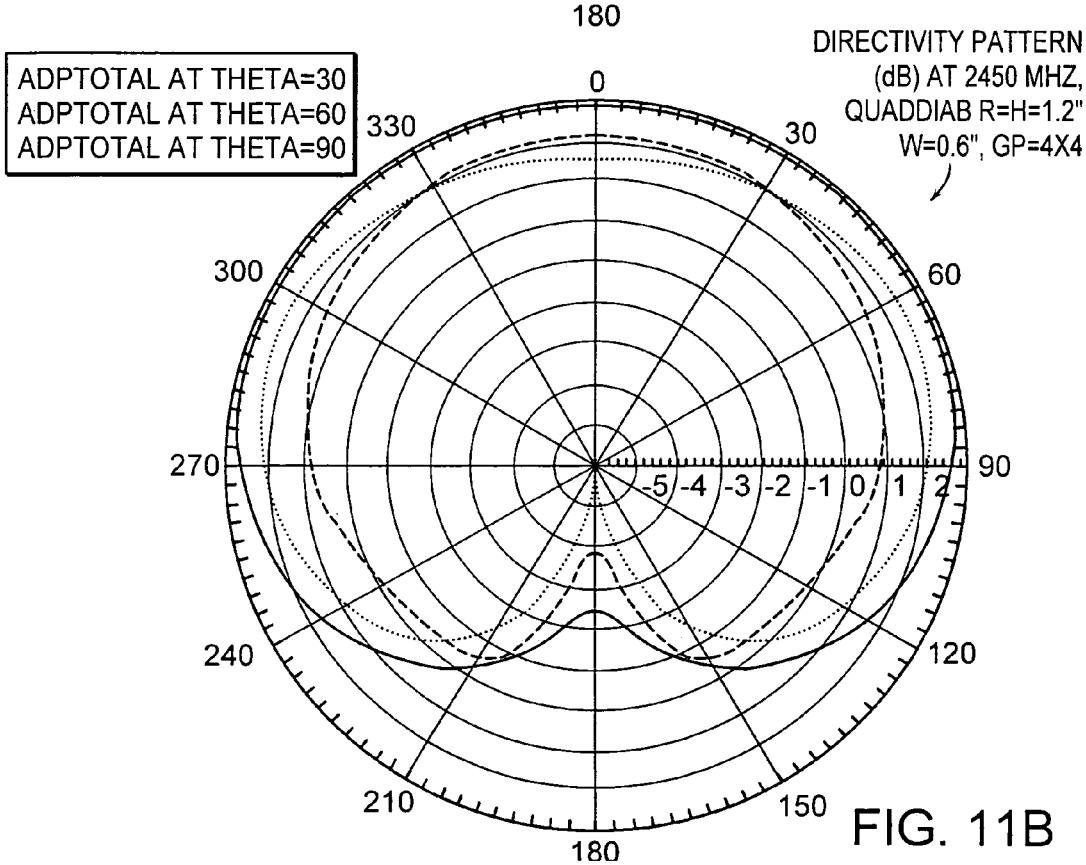
Figure 11C:
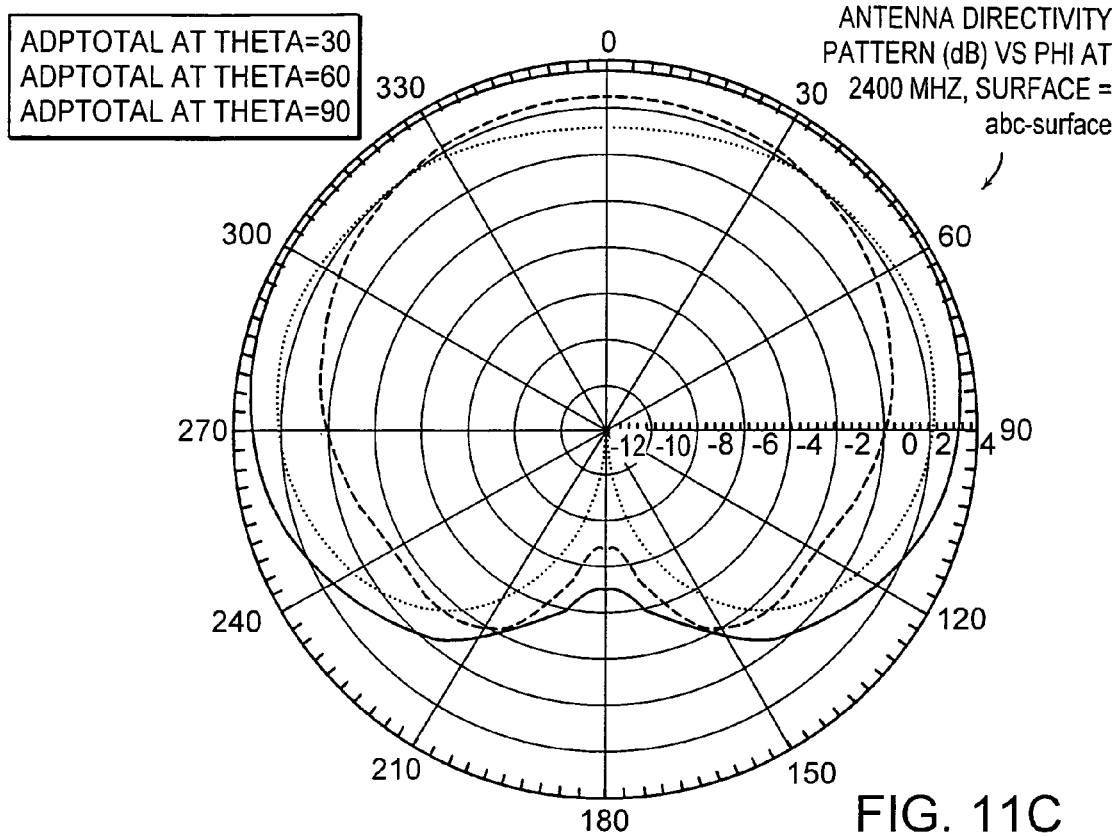

Referring now to FIGS. 11A-11C, these simulated antenna directivity (i.e., beam) patterns correspond to the antenna beams produced by the active antenna 910 in the antenna assembly 900 that lies along the +x axis. Each of FIGS. 11A-11C have three antenna directivity curves for theta=30, 60, and 90 degrees, where the angles are degrees from zenith (i.e, zero degrees points along the +z axis. The simulations of FIGS. 11A-11C are for 2.50, 2.45, and 2.40 GHz, respectively.

Figure 11D:
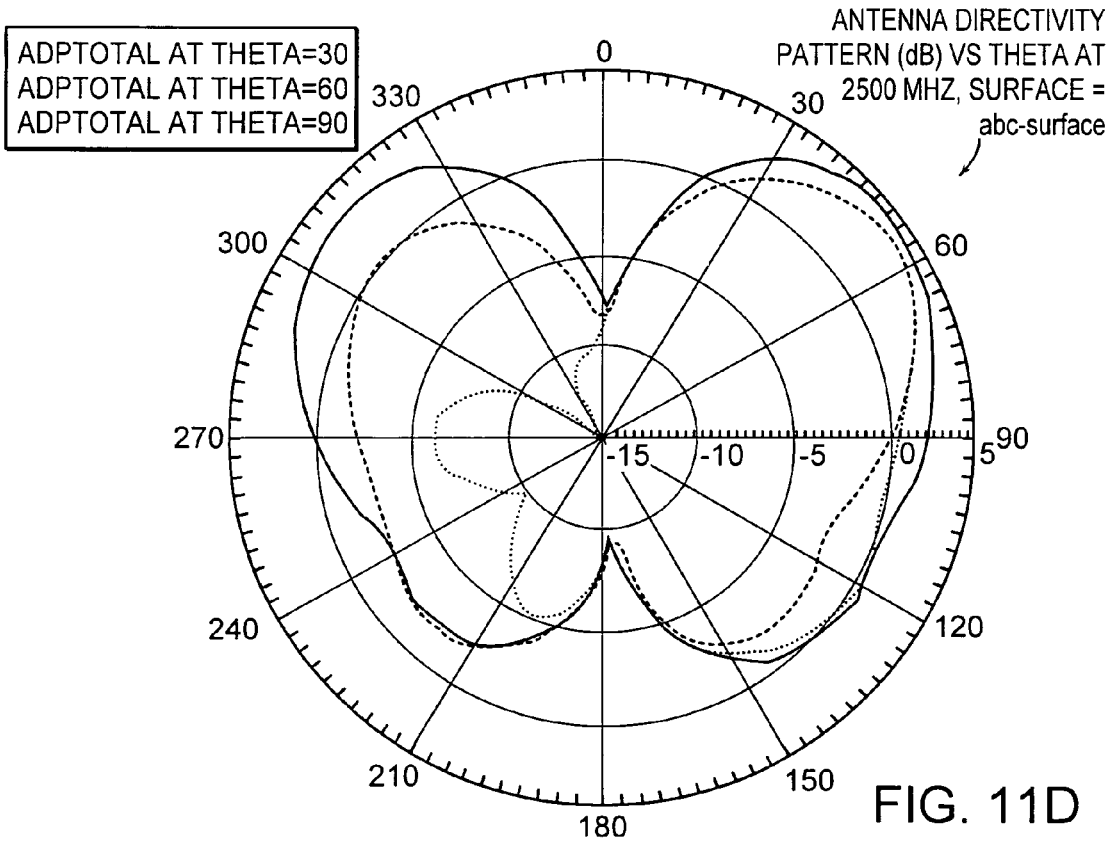
FIGS. 11D-11F are antenna directivity patterns for the antenna assembly of FIG. 9.
Figure 11E:
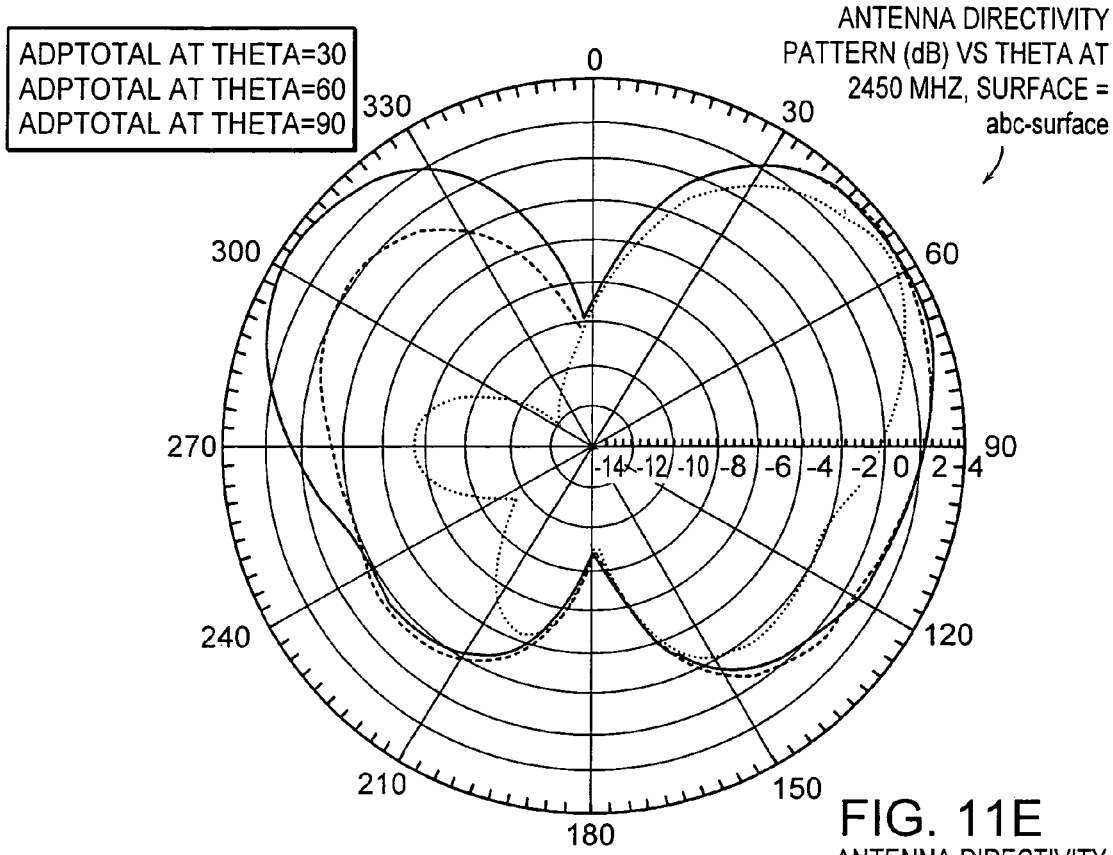
Figure 11F:
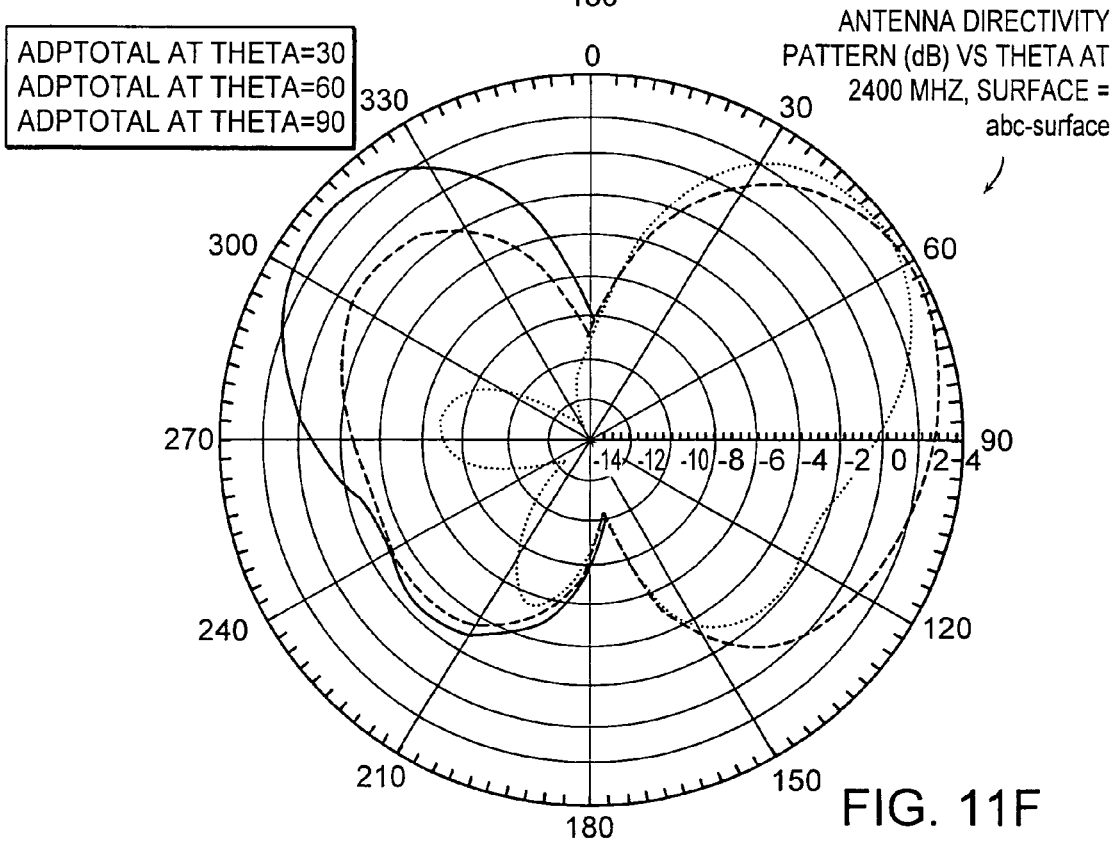

FIGS. 11D-11F are simulated antenna directivity patterns for the elevation direction corresponding to the simulated antenna directivity (i.e., beam) patterns of FIGS. 11A-11C. The three curves correspond to Phi=0, 45, and 90 degrees, where the angles are degrees from zenith.

Figure 12A:
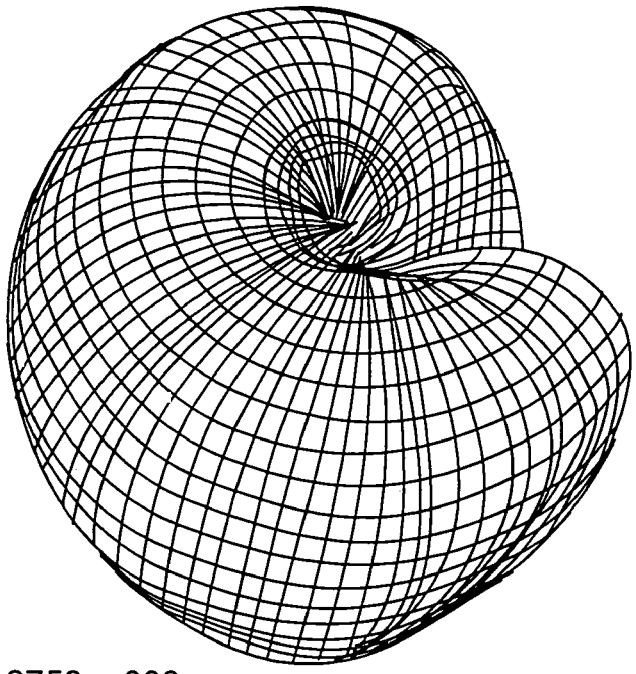
FIGS. 12A-12C are three-dimensional antenna directivity patterns for the antenna assembly of FIG. 9.
Figure 12B:
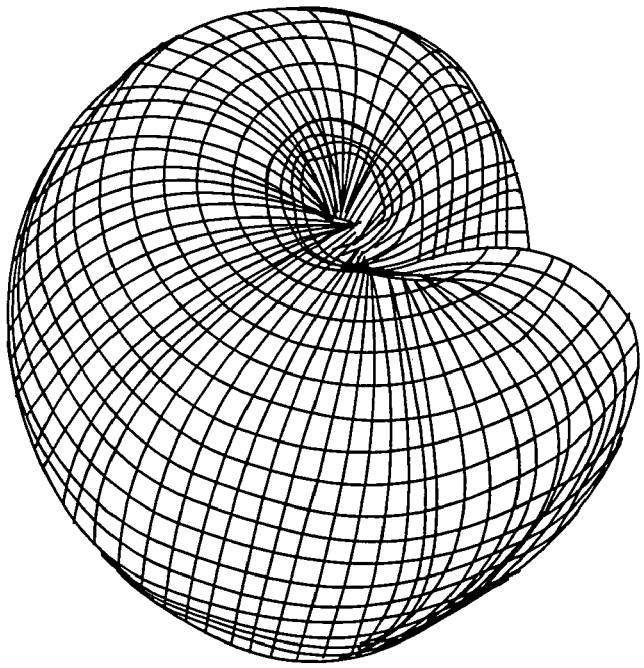
Figure 12C:
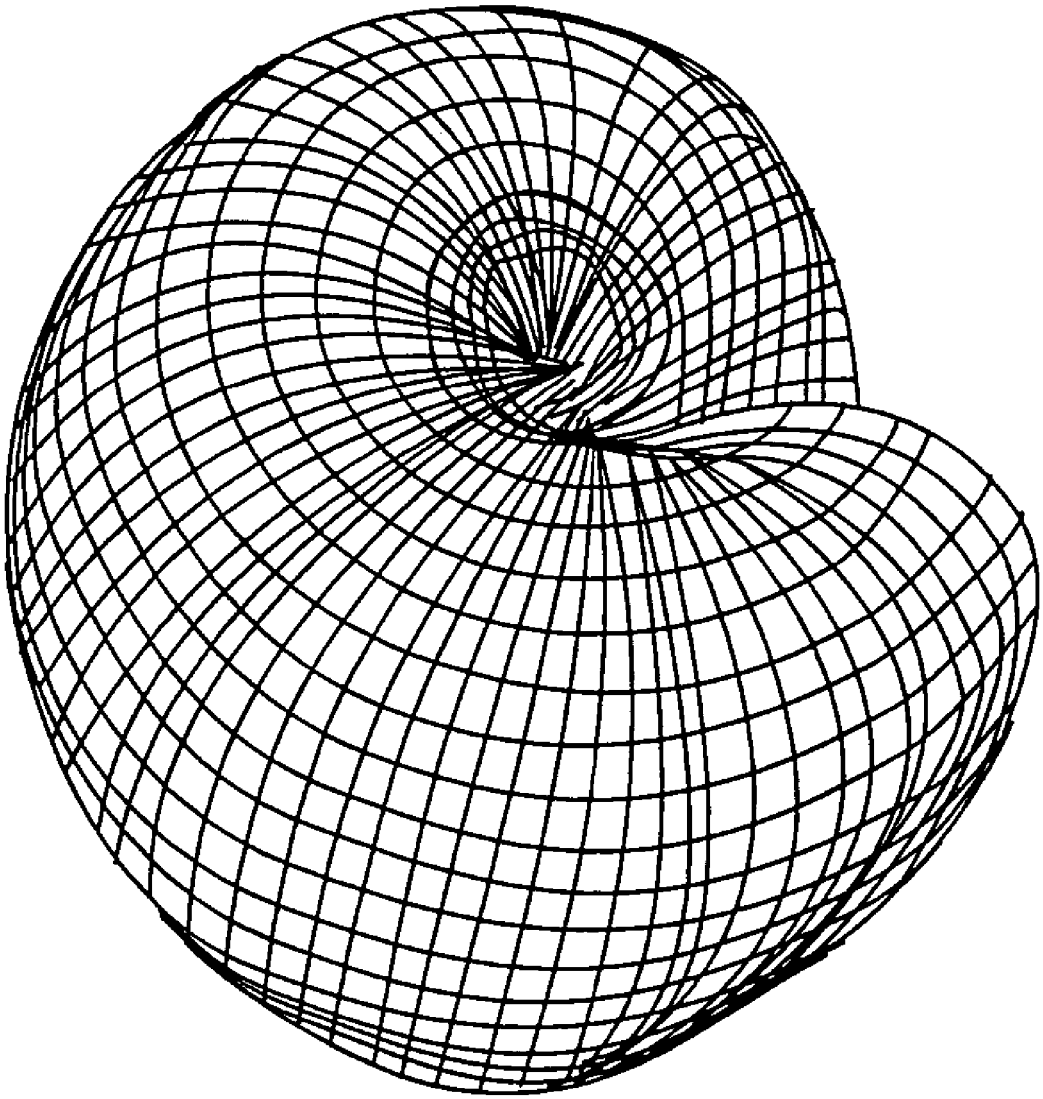

FIGS. 12A-12C are three-dimensional plots corresponding to the cumulative plots of FIGS. 11A-11F.

Figure 13A:
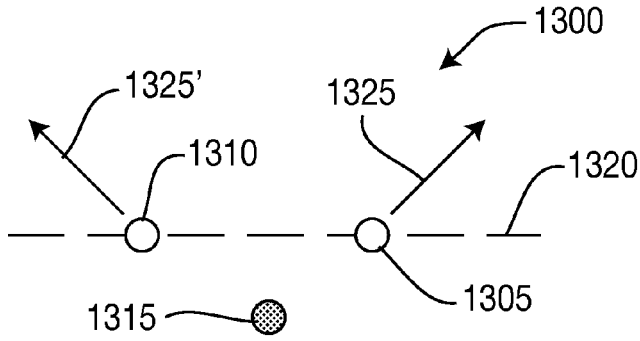
FIGS. 13A and 13B show a plan view and a perspective view of another embodiment of the antenna assembly.
Figure 13B:
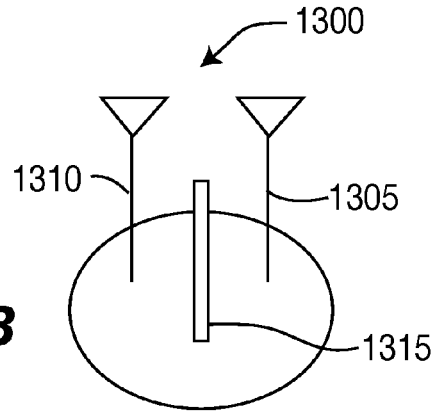

Turning now to FIG. 13A through 13B, there is shown an alternative embodiment of the present disclosure being shown in a plan view of FIG. 13A and shown in a perspective view in FIG. 13B. In this embodiment, antenna assembly 1300 includes a first active antenna element 1305 and a second active antenna element 1310. The antenna assembly 1300 further has a beam control element 1315 that is disposed between the first active antenna element 1305 and the second active antenna element 1310. The antenna assembly 1300 may have a geometric arrangement configured with an axis 1320 that defines the first active antenna element 1305 and the second active antenna element 1310 and is disposed offset relative to the beam control element 1315.

As discussed above with regard to the embodiment of FIG. 1, two beams 1325, 1325' may be simultaneously formed in opposite directions when beam control antenna element 1315 is switched or fed to a terminating reactance (not shown). The first terminating reactance (not shown) operates similar to the embodiment shown in FIG. 1 and permits the beam control element 1315 to operate as a reflector or director as previously described.

Figure 14A:
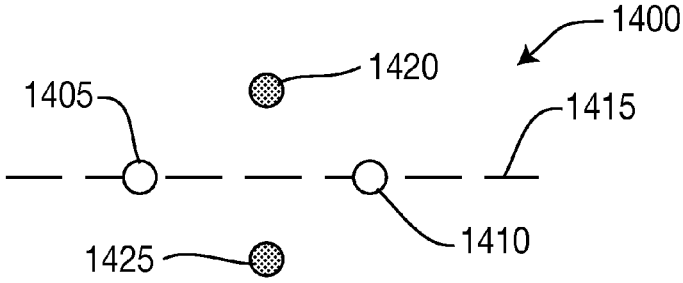
FIGS. 14A and 14B show plan views of another embodiment of an antenna assembly.

Turning now to FIG. 14A, there is shown an alternative embodiment of the present antenna assembly 1400 in a plan view. In this embodiment, the antenna assembly 1400 includes a first active antenna element 1405 and a second active antenna element 1410. The first active antenna element 1405 and the second active antenna element 1410 are disposed on an axis 1415. The antenna assembly 1400 further has multiple beam control elements 1420, 1425, including a first beam control element 1420 and a second beam control element 1425 optionally arranged in perpendicular, angular, random or other forms of alignment with the axis 1415. However, it is envisioned that the antenna assembly 1400 may have three, four, or multiple beam control elements. As illustrated in FIG. 14A, the first beam control element 1420 and the second beam control element 1425 are disposed directly across from one another with respect to the axis 1415.

In this embodiment, the first beam control element 1420 and the second beam control element 1425 are each disposed between the first active antenna element 1405 and the second active antenna element 1410 in an offset arrangement. This arrangement permits electromagnetic coupling that changes a shape of the beams that are emitted from the active antenna elements 1405, 1410. In this embodiment, the antenna assembly 1400 has an arrangement that the axis 1415 connecting the first active antenna element 1405 and the second active antenna element is generally offset relative to each of the beam control elements 1420, 1425, or, more particularly, in this embodiment, the first and second beam control elements 1420, 1425 are each positioned at a predetermined distance measured from the axis. In one embodiment, the first beam control element 1420 may be a first distance away from the axis 1415 while the second beam control element 1425 is the same first distance away from the axis 1415. Alternatively, the second beam control element 1425 may separated from the axis 1415 by another second distance.

Figure 14B:
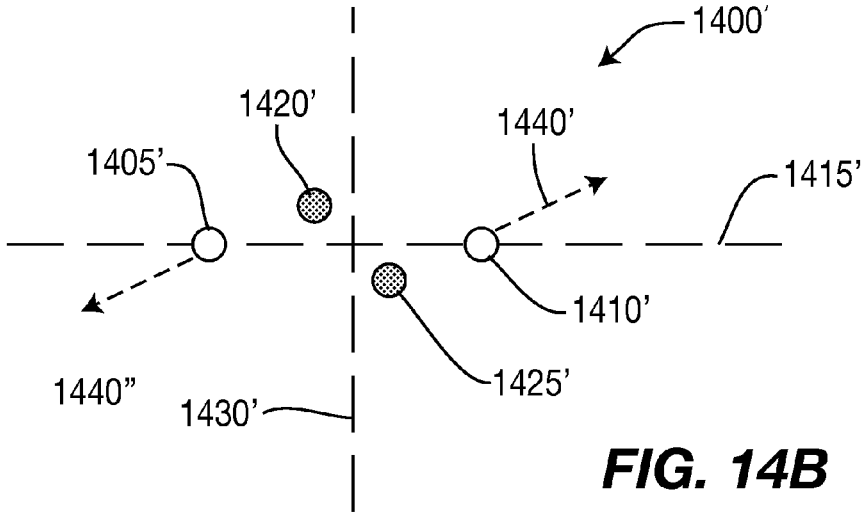

The embodiment of FIG. 14B may include example beam patterns similar to those beam patterns 510, 515 arranged in FIG. 5. The beams 1417, 1418 may be simultaneously formed in opposite directions and in a different pattern when compared to the embodiment of FIGS. 13A and 13B when beam control antenna elements 1420, 1425 are switched or fed to a respective terminating reactance operating similar to the embodiment shown in FIG. 5 which permits the beam control elements 1420, 1425 to in reflective or transmissive mode.

Turning now to FIG. 14C, which shows still another further embodiment of the present disclosure, there is shown antenna assembly 1400' in a plan or top view. In this embodiment, the antenna assembly 1400' includes a first active antenna element 1405' and a second active antenna element 1410' with both disposed on an axis 1415'. The antenna assembly 1400' further has multiple beam control elements 1420', 1425', such as a first beam control element 1420' and a second beam control element 1425' with both of the first and second beam control antenna elements 1420'1425' being generally disposed between the active antenna elements 1405', 1410'. However, it is envisioned that this arrangement is merely exemplary and non-limiting, and the antenna assembly 1400' may have three, four, or several beam control elements with all of the beam control elements similarly disposed and electromagnetically parasitically coupled to the two active antenna elements 1405', 1410'.

In this embodiment, the first beam control element 1420' and a second beam control element 1425' are disposed offset relative to an imaginary axis 1430' that previously connected the first beam control element 1420' and the second beam control element 1425' as shown in FIG. 14A. However, both the first beam control element 1420' and the second beam control element 1425' are positioned between the first active antenna element 1405' and the second active antenna element 1410'.

This offset arrangement of the first and the second beam control elements 1420', 1425' is useful since the offset nature changes a shape of the beams 1440', 1440" that are emitted from the respective active antenna elements 1405', 1410'. In this embodiment, the antenna assembly 1400' produces beams 1440', 1440" with a maximum directivity when the beam control elements 1420', 1425' are configured to be reflective. Again, as discussed above with regard to the embodiment of FIG. 5, two beams 1440', 1440" may be simultaneously formed in opposite directions when beam control antenna elements 1420', 1425' are switched or fed to a respective terminating reactance operating similar to the embodiment shown in FIG. 2 to configure the beam control elements 1420', 1425' to operate in reflective or directive modes.

However, in this embodiment, if the first beam control antenna element 1420' is positioned in close proximity to the first active antenna element 1405', the angle of a maximum directivity of the beam 1440" formed from the first active antenna element 1405' in the plan view tends to be spanning or directed from a line that is formed between the respective active element 1405' and the beam control element 1420, or at an angle measure from axis 1415'. In one embodiment, the close proximity of the first active antenna element 1405' to the first beam control antenna element 1420' may be within a half wavelength. Various other distances may be possible and within the scope of the present disclosure.

Figure 15:
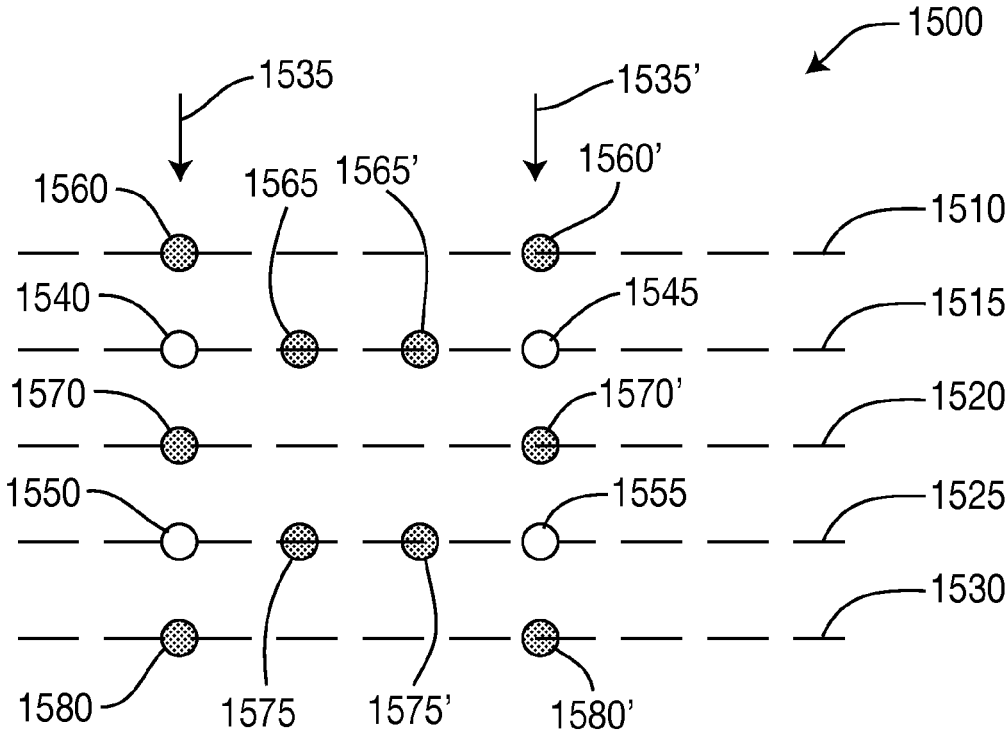
FIG. 15 shows a plan view of a non-linear array antenna assembly.

Turning now to FIG. 15, there is shown still another alternative embodiment of the present disclosure. In this embodiment, the antenna assembly 1500 is arranged in a two-dimensional array with a number of rows, or first row 1510, second row 1515, third row 1520, fourth row 1525, and fifth row 1530. The antenna assembly 1500 may be fashioned with additional rows 1525*n*. It should be appreciated that the first through fifth rows 1510, 1515, 1520, 1525, and 1530 form a two dimensional array of beam control antenna elements and active antenna elements. The two dimensional array of beam control antenna elements and active antenna elements forms a split configuration or a first configuration generally represented by reference numeral 1535 and a second configuration 1535'. The first configuration 1535 may be the same or different from the second configuration 1535'.

In one embodiment, the first configuration 1535 may have first active antenna elements 1540, 1545 disposed in the second row 1515 and second active antenna elements 1550, 1555 in the third row 1525. The antenna assembly 1500 further includes beam control elements with the first configuration 1535 including a first beam control antenna element 1560, second beam control antenna element 1565, third beam control antenna element 1570, fourth beam control antenna element 1575, and fifth beam control antenna element 1580. The first through fifth beam control antenna elements 1560, 1565, 1570, 1575, and 1580 form a curved, curvilinear or otherwise sinusoidal wave pattern with the first, second and third beam control antenna elements 1560, 1565, 1570 surrounding the first active antenna element 1540 and the third through fifth beam control antenna elements 1570, 1575, 1580 surrounding the active antenna element 1550 in the first configuration 1535.

The second configuration 1535' also has a similar arrangement to form a two-dimensional array. The second configuration 1535' may include a similar or different arrangement and may further include beam control elements similar to the first configuration 1535. The second configuration 1535' includes a first beam control antenna element 1560', second beam control antenna element 1565', third beam control antenna element 1570', fourth beam control antenna element 1575', and fifth beam control antenna element 1580'. The first through fifth beam control antenna elements 1560', 1565', 1570', 1575', and 1580' likewise form a second sinusoidal wave pattern in mirror image with the first sinusoidal wave pattern in this embodiment. The first, second and third beam control antenna elements 1560', 1565', 1570' surround the active antenna element 1545, and the third through fifth beam control antenna elements 1570', 1575', and 1580' surround the active antenna element 1555. It should be appreciated that other trigonometric functions may be formed such as other shaped sine waves, a cosine wave, tangents, or other trigonometric functions in mirror image or in a non-mirror image.

In this manner, the first configuration 1535 provides beam direction, isolation and shape control to each of the active antenna elements 1540, 1550, which transmit beams. Likewise, the second configuration 1535' provides beam direction, isolation and shape control to each of the active antenna elements 1545, 1555, which transmit directive beams that are isolated. It should further be appreciated that the respective directive beams can be narrowed or broadened depending on the arrangement of the first and second configurations 1535, 1535' and other beam control reflective elements may be added to broaden or otherwise shape the respective beams. Moreover, the distance between or among each or all of the active antenna elements and some reflector elements of the first and second configurations 1535, 1535' may be varied in order to further shape or isolate the directive beams. Various configurations are possible and within the scope of the present disclosure.

Figure 16:
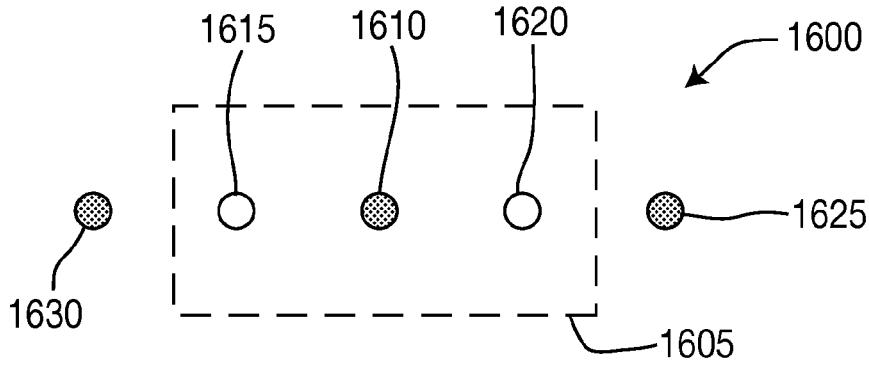
FIG. 16 shows a plan view of another embodiment of the antenna assembly having antenna elements positioned outside of an array.

Turning now to an alternative embodiment of the present disclosure shown in FIG. 16, in this embodiment of the antenna assembly 1600, there may be an array 1605 of beam control antenna element(s) 1610 and active antenna elements 1615, 1620. The array 1605 shown in dotted lines may include any of the previously described embodiments discussed above for a one dimensional or two dimensional array or alternatively may include or be statically or dynamically configured as a Yagi antenna array, or a combination of arrays. However, in this embodiment, the active antenna element 1615, 1620 of the array 1605 may have an increased gain based on antenna elements 1625, 1630 that are external from the antenna array 1605. In the embodiment shown in FIG. 16, the antenna assembly 1600 includes a first beam control antenna element 1625 and a second beam control antenna element 1630 disposed on the lateral sides and positioned spaced from the array 1605.

In the embodiment shown in FIG. 16, the antenna assembly 1600 may be configured to include reflective or directive antenna elements positioned outside of the array 1605 in order to change the beam configuration, such as making the beam narrower or broadening the beam as discussed previously. For example, the array 1605 of FIG. 16 may be configured as the antenna assembly 1500 of FIG. 15 and may further include two beam control antenna elements 1625, 1630 positioned outside of, and positioned spaced from, the array 1605. In one embodiment, the spacing may be one half or one wavelength from the array 1605. In another embodiment, each element 1625, 1630 may be positioned at multiple wavelengths from the array 1605, and in still a further embodiment of the present invention, antenna element 1630 may be positioned from the array by a different distance as compared to the distance from antenna element 1625 from the array 1605. Various configurations are possible and within the scope of the present disclosure.

Figure 17A:
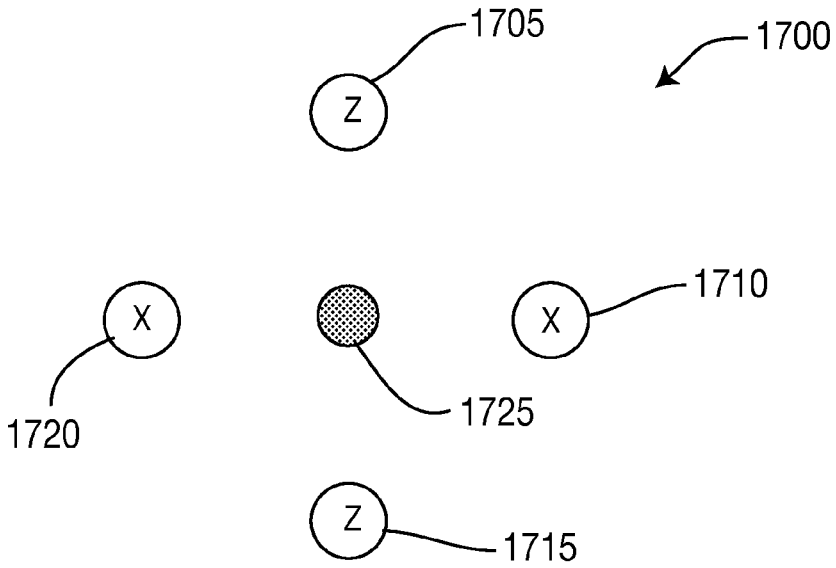
FIGS. 17A and 18 show two plan views of two antenna assemblies with dual band active antenna elements.

Turning now to still a further embodiment of the present disclosure shown in FIG. 17A, there is shown a multi-band (e.g., dual band) operation antenna assembly 1700. In this embodiment, the antenna assembly 1700 includes a number of active antenna elements 1705, 1710, 1715, and 1720 operating at different frequencies. The antenna assembly 1700 also has a beam control antenna element 1725. In this embodiment, the beam control antenna element 1725 is disposed in a centermost portion surrounded by the active antenna elements 1705, 1710, 1715, and 1720. In one non-limiting embodiment, the antenna assembly 1700 may be made with two different active antenna elements, or active antenna elements 1705 and 1715 operating at a first frequency and active antenna elements 1710 and 1720 operating at a second different frequency. In this manner, the first frequency and the second frequency may be separated far from one another in frequency in order to provide for a weak coupling between the active antenna elements and the beam control antenna element. It should be appreciated that each active antenna element 1705, 1710, 1715, and 1720 may be a multi-band antenna element connected to electronics supporting multiple frequencies as understood in the art. Various configurations are possible and within the scope of the present disclosure.

Figure 18:
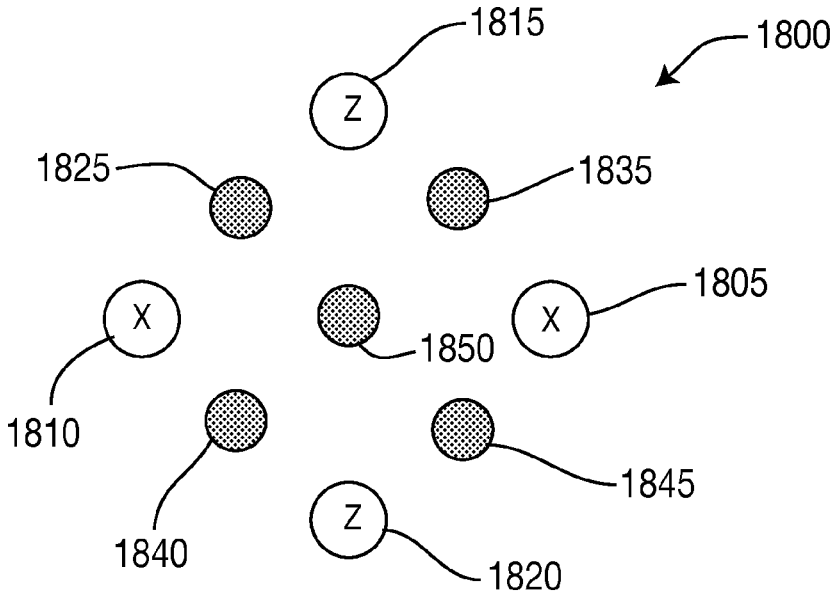

In another embodiment of the present disclosure shown as FIG. 18, there is shown another antenna assembly 1800 including multiple active antenna elements, such as a first active antenna element 1805, second active antenna element 1810, third active antenna element 1815, and fourth active antenna element 1820. This embodiment is similar to the embodiment of FIG. 17A, but includes several beam control elements 1825, 1835, 1840, 1845 and 1850. In this embodiment, the active antenna elements 1805 and 1810 operate at a first frequency while other active antenna elements 1815, 1820 may operate at a second different frequency.

In this embodiment, the beam control elements 1825, 1830, 1835, 1840, 1845 and 1850 are positioned in a centermost portion of the antenna assembly 1800 while the multiple active antenna elements, 1805, 1810, 1815, and 1820 surround the beam control antenna elements 1825, 1835, 1840, 1845 and 1850. If the frequency of the transmitted signal from the active antenna elements 1815, and 1820 is close or relatively close to the frequency of the transmitted signal from the active antenna elements 1805, and 1810, then multiple beam control antenna elements are desired to provide isolation. This is in comparison to the embodiment of FIG. 17A where the frequency of the transmitted signal from the active antenna elements 1705 and 1715 is far relative to the frequency of the transmitted signal from the active antenna elements 1710 and 1720. In this antenna assembly 1700, one beam control antenna element 1725 may be desired and sufficient for isolation and coupling.

Figure 19:
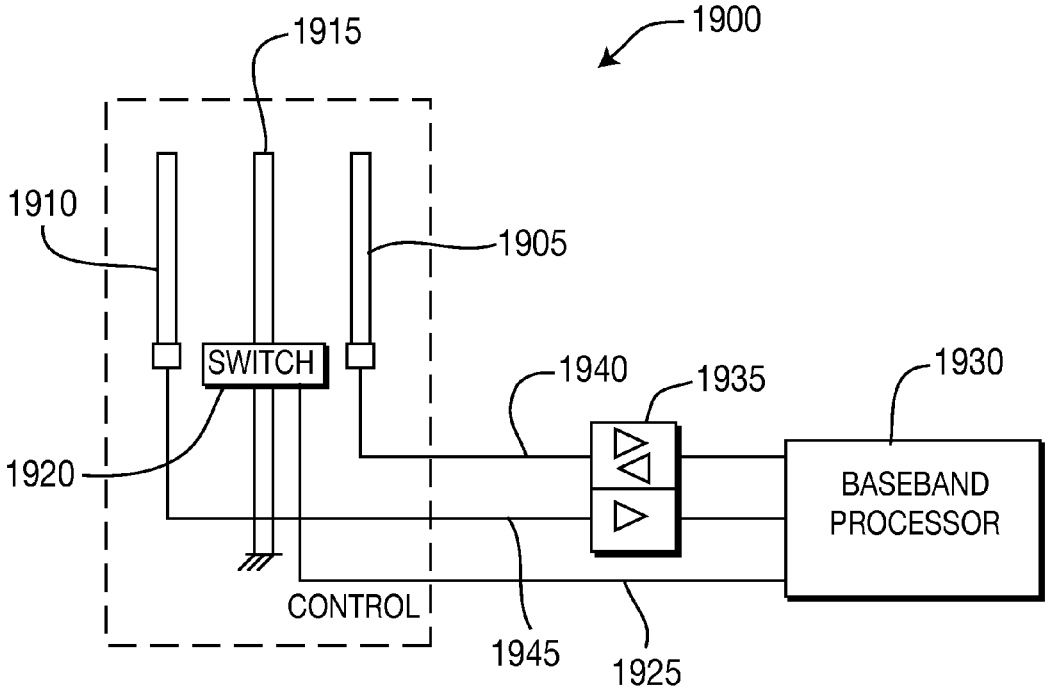
FIGS. 19 and 20 show embodiments of a multiple receiver switched mode antenna.

Turning now to FIG. 19, there is shown another embodiment of the present disclosure showing a multiple receiver switched mode antenna assembly 1900. In this embodiment, it should be appreciated that the present antenna assembly 1900 may yield position diversity by receiving the same signal in two different locations. The present antenna 1900 may be a single transceiver switched beam antenna that offers antenna gain, interference rejection, and spatial diversity at low cost. The multiple receiver switched mode antenna 1900 of the present disclosure includes multiple receivers 1935 and a multiple-input-multiple-output based air interface which can separate receive and transmit functions within the same antenna and also include backward compatibility.

The multiple receiver switched mode antenna assembly 1900 of the present disclosure may select between a beam for high gain and an omni-directional antenna mode optionally used in multi-path environments. The present antenna assembly 1900 includes multiple simultaneous resonant active antenna elements 1905, 1910 for transmitting and receiving functions and a parasitic element 1915. The parasitic element 1915 is connected to a switch 1920 and is further connected to ground via the switch. In one embodiment, the parasitic element 1915 is about ⅛ wavelength from the active antenna elements 1905, 1910; however the parasitic and active antenna elements may be separated by other distances.

In one embodiment, the parasitic element 1915 is connected to switch 1920 and is disposed in a center or between the active antenna elements 1905, 1910 or in a similar arrangement to the previously described embodiments. As described above with regard to the previously described embodiments, the parasitic element 1915 is operatively connected to the switch 1920, which is connected to an impedance, lumped impedance, or similar reactance, and the parasitic element 1915 can be switched between being a directive or a reflective element.

Figure 20:
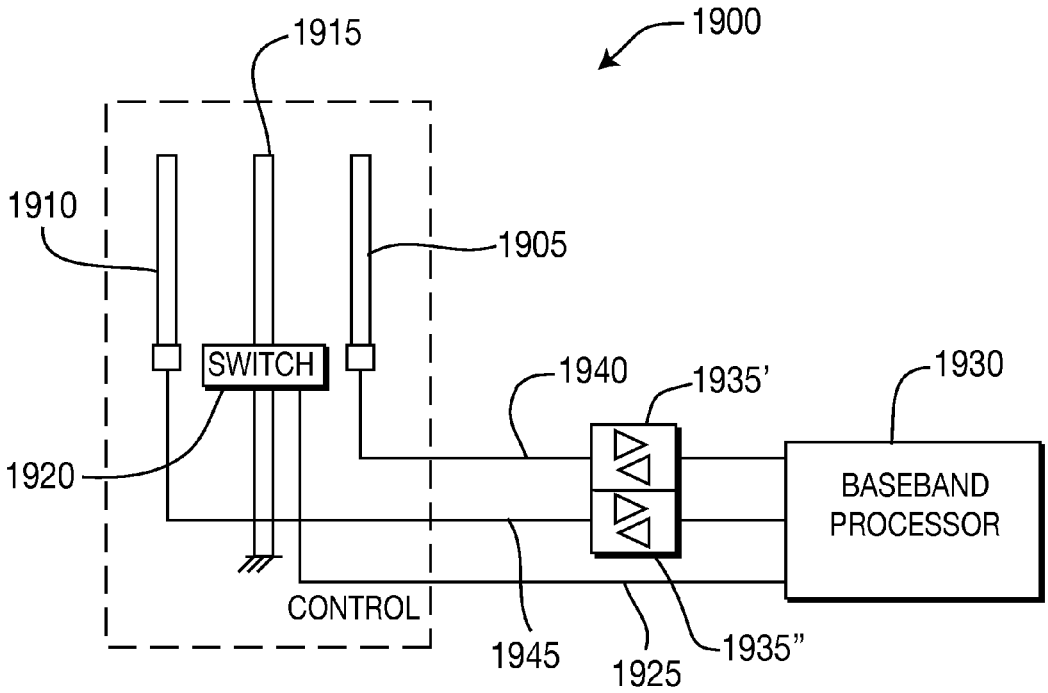

When switched to be a reflector, the parasitic element 1915 decouples the active antenna element 1905, which may cause the antenna assembly 1900 to transmit multiple simultaneous beams. The parasitic element 1915 is connected by a control line 1925 to a baseband processor 1930. The baseband processor 1930 may be operatively connected to a controller (not shown) or it may include control functions to provide a feedback control signal to the antenna 1900 via the control line 1925. It should be understood that open-loop control may also be employed. The active antenna elements 1905, 1910 are also respectively coupled to a transmitter and dual receiver 1935 along leads 1940, 1945. In another alternative embodiment, such as shown in FIG. 20, active antenna elements 1905, 1910 can be also respectively coupled to a dual transceiver 1935', 1935" along leads 1940, 1945. The antenna 1900 further provides link gain to the channels which can reduce interference through a directive null beam pattern as previously described. Alternatively, with the center parasitic element 1915 switched to affect directivity of the antenna assembly 1900, the antenna 1900 may form multiple simultaneous omni-directional antenna beams of various selectable directivities, and in some configurations form a single or multiple beam(s), which may improve multiple receive and multiple-input-multiple-output system performance. The antenna 1900 can transmit or receive in either a directional mode or in an omni-directional mode.

In one embodiment, the antenna assembly 1900 can transmit in the omni-directional mode, but receive in a directional mode. In still another embodiment, the antenna 1900 can transmit in directional mode, but receive in the omni-directional mode. In another further embodiment, the antenna 1900 can transmit and receive both in the directional mode, and an omni-directional mode.

The baseband processor 1930 may further include hardware or a processor (not shown) configured to execute signal processing software or firmware to vary the antenna configuration by determining an optimal channel characteristic and using the channel characteristic to select a given or multiple directional mode(s). In one embodiment, the transmitter and/or the receiver 1935', 1935" may be switched into directional modes to create distinct multiple paths. Each of the paths may further have a directional link gain. In this embodiment, the antenna selection which had been previously controlled the impedance, now may be further used to select which one of the multiple antenna receivers or transmitters 1935 is desired to transmit/receive the signal of FIG. 19. The baseband processor 1930 controls the omni-directional mode selection by controlling the antenna element parasitic impedance and allows for one of the transmitters to operate. This is advantageous since the antenna assembly 1900 may be manufactured with a single impedance switch circuit, as compared to other embodiments with multiple impedance switch circuits, which leads to lower cost.

While this invention has been particularly shown and described with references to preferred embodiments thereof, it will be understood by those skilled in the art that various changes in form and details may be made therein without departing from the scope of the invention encompassed by the appended claims.

What is claimed is:

1. An apparatus, comprising:

multiple active antenna elements arranged in a linear configuration; and multiple beam control antenna elements electromagnetically coupled to the multiple active antenna elements and electromagnetically disposed between at least two of the active antenna elements, the multiple beam control antenna elements interspersed among the multiple active antenna elements in a configuration approximating at least a portion of a trigonometric function.

2. The apparatus of claim 1, further comprising:

multiple second active antenna elements arranged in a second linear configuration; and multiple second beam control antenna elements electromagnetically coupled to the multiple second active antenna elements and electromagnetically disposed between at least two of the second active antenna elements, the multiple second beam control antenna elements interspersed among the multiple second active antenna elements in a second configuration approximating at least a portion of a trigonometric function.

3. The apparatus of claim 1, wherein the trigonometric function is a sine wave.

4. An apparatus, comprising:

multiple active antenna elements; and multiple beam control antenna elements electromagnetically coupled to the multiple active antenna elements and electromagnetically disposed between at least two of the active antenna elements;

at least a subset of the multiple active antenna elements and at least a subset of the multiple beam control antenna elements being disposed in a plurality of rows for a predetermined array; and a plurality of beam control antenna elements being positioned outside of the array configured to provide for active antenna gain of the array.

5. The apparatus of claim 4, wherein the predetermined array comprises the beam control antenna elements approximating a portion of a sine wave.

6. The apparatus of claim 5, wherein the plurality of beam control antenna elements being positioned outside of the array comprise at least a first beam control antenna element spaced from a first lateral side of the array and at least a second beam control antenna element spaced from a second lateral side of the array with the first and the second beam control antenna elements being generally aligned relative to one another.

7. The apparatus of claim 4, wherein the plurality of beam control antenna elements are positioned outside of the array by respective predetermined distances.

8. An apparatus, comprising:

a plurality of active antenna elements, the plurality of active antenna elements being configured to operate in different frequency ranges; and at least one beam control antenna element electromagnetically disposed between the active antenna elements.

9. The apparatus of claim 8, wherein the active antenna elements individually support multiple frequency bands.

10. The apparatus of claim 9, wherein at least two active antenna elements of different frequency bands are isolated with at least two beam control elements electromagnetically disposed between at least two active elements of different frequency bands.

11. An apparatus comprising:

at least two active antenna elements each coupled to a respective receiver and transmitter, and configured to form multiple simultaneous beams;

a beam control antenna element being coupled to a switch, the switch operatively coupling the beam control antenna elements to a device to effect at least one antenna beam pattern formed by the at least two active antenna elements; and a controller coupled to the beam control antenna element and coupled to the respective receiver and transmitter, the controller configured to switch between transmitting and receiving in a directional mode or transmitting and receiving in an omni-directional mode.

* * * * *